US011747030B2

(12) United States Patent
Fischer et al.

(10) Patent No.: US 11,747,030 B2
(45) Date of Patent: Sep. 5, 2023

(54) MULTI-ZONE CHILLED BEAM SYSTEM AND METHOD WITH PUMP MODULE

(71) Applicant: SEMCO LLC, Columbia, MO (US)

(72) Inventors: John C. Fischer, Marietta, GA (US); Aaron S. Bentley, Fayette, MO (US); David C. Reed, Columbia, MO (US)

(73) Assignee: SEMCO LLC, Columbia, MO (US)

( * ) Notice: Subject to any disclaimer, the term of this patent is extended or adjusted under 35 U.S.C. 154(b) by 0 days.

(21) Appl. No.: 17/690,805

(22) Filed: Mar. 9, 2022

(65) Prior Publication Data

US 2022/0290879 A1 Sep. 15, 2022

Related U.S. Application Data

(60) Provisional application No. 63/160,629, filed on Mar. 12, 2021.

(51) Int. Cl.
*F24F 5/00* (2006.01)
*F24F 11/84* (2018.01)
(Continued)

(52) U.S. Cl.
CPC ..... *F24F 5/0089* (2013.01); *F24F 11/32* (2018.01); *F24F 11/84* (2018.01); *F24F 11/85* (2018.01);
(Continued)

(58) Field of Classification Search
CPC .. F24F 11/32; F24F 11/84; F24F 11/85; F24F 11/64; F24F 2110/10; F24F 2110/20;
(Continued)

(56) References Cited

U.S. PATENT DOCUMENTS 3,009,684 A 11/1961 Munters
3,069,867 A 12/1962 Ringquist
(Continued)

FOREIGN PATENT DOCUMENTS

DE 1389256 4/1975
EP 1 795 852 6/2007
(Continued)

OTHER PUBLICATIONS

Pinnacle Technical Guide, SEMCO.
(Continued)

*Primary Examiner* — Nelson J Nieves
(74) *Attorney, Agent, or Firm* — Allan Watts

(57) ABSTRACT

Air conditioning systems for cooling multiple-zone spaces, each zone having a thermostat, where each of multiple pump modules delivers chilled water to chilled beams in a plurality of zones and a chilled-water distribution system circulates chilled water through a chilled-water distribution loop to the multiple pump modules. Current dew points are determined in zones that call for cooling, and temperature of chilled water delivered to the chilled beams is maintained for each pump module at least a predetermined temperature differential above the highest dew point within the zones served by that pump module. Each zone has a zone control valve to shut off flow to that zone. Serving a plurality of zones from each pump module reduces how many pump modules are required. Zones served by one pump module may be selected to have similar thermal loads. Pump modules may supply hot water when heat is needed instead of cooling.

25 Claims, 8 Drawing Sheets

Multi-Zone Riser Configuration with Diverting Valve
(Pump operates continuously with at least 1 diverting valve)

(51) Int. Cl.

| | |
|---|---|
| ***F24F 11/85*** | (2018.01) |
| ***F24F 11/32*** | (2018.01) |
| *F24F 110/10* | (2018.01) |
| *F24F 110/20* | (2018.01) |
| *F24F 140/20* | (2018.01) |

(52) U.S. Cl.
CPC ..... *F24F 2110/10* (2018.01); *F24F 2110/20* (2018.01); *F24F 2140/20* (2018.01); *F24F 2221/34* (2013.01)

(58) Field of Classification Search
CPC .... F24F 5/0089; F24F 5/0096; F24F 2140/20; F24F 2221/34
See application file for complete search history.

(56) References Cited

U.S. PATENT DOCUMENTS

| | | | | |
|---|---|---|---|---|
| 3,127,929 | A | 4/1964 | Ringquist | |
| 3,144,901 | A | 8/1964 | Meek | |
| 3,170,508 | A | 2/1965 | Avery | |
| 3,176,759 | A | 4/1965 | Windham | |
| 3,256,929 | A | 6/1966 | Carlson | |
| 3,288,205 | A | 11/1966 | Egbert | |
| 3,303,873 | A | 2/1967 | Ringqulst | |
| 3,378,062 | A | 4/1968 | Ringqulst | |
| 3,384,155 | A | 5/1968 | Newton | |
| 3,425,485 | A | 2/1969 | Newton | |
| 3,685,574 | A | 8/1972 | Worms | |
| 3,693,704 | A | 9/1972 | Newton | |
| 3,844,737 | A | 10/1974 | Macriss | |
| 3,910,345 | A | 10/1975 | Whalen | |
| 4,067,383 | A | 1/1978 | Padden | |
| 4,150,788 | A | 4/1979 | Matsumoto | |
| 4,456,456 | A | 6/1984 | Pompei | |
| 4,475,932 | A | 10/1984 | Hull | |
| 4,484,938 | A | 11/1984 | Okamoto | |
| 4,555,253 | A | 11/1985 | Hull | |
| 4,582,129 | A | 4/1986 | Yano | |
| 4,594,860 | A | 6/1986 | Coellner | |
| 4,718,478 | A | 1/1988 | Huber | |
| 4,719,761 | A | 1/1988 | Cromer | |
| 4,723,417 | A | 2/1988 | Meckler | |
| 4,729,774 | A | 3/1988 | Cohen | |
| 4,769,053 | A | 9/1988 | Fischer | |
| 4,903,503 | A | 2/1990 | Meckler | |
| 4,955,205 | A | 9/1990 | Wilkinson | |
| 4,987,748 | A | 1/1991 | Meckler | |
| 5,131,238 | A | 7/1992 | Meckler | |
| 5,170,633 | A | 12/1992 | Kaplan | |
| 5,176,005 | A | 1/1993 | Kaplan | |
| 5,181,387 | A | 1/1993 | Meckler | |
| 5,300,138 | A | 4/1994 | Fischer | |
| 5,373,704 | A | 12/1994 | McFadden | |
| 5,401,706 | A | 3/1995 | Fischer | |
| 5,448,895 | A | 9/1995 | Coellner | |
| 5,496,397 | A | 3/1996 | Fischer | |
| 5,517,828 | A | 5/1996 | Calton | |
| 5,526,651 | A | 6/1996 | Worek | |
| 5,542,259 | A | 8/1996 | Worek | |
| 5,551,245 | A | 9/1996 | Calton | |
| 5,579,647 | A | 12/1996 | Calton | |
| 5,649,428 | A | 7/1997 | Calton | |
| 5,660,048 | A | 8/1997 | Belding | |
| 5,727,394 | A | 3/1998 | Belding | |
| 5,758,511 | A | 6/1998 | Yoho | |
| 5,761,915 | A | 6/1998 | Rao | |
| 5,771,707 | A | 6/1998 | Lagace | |
| 5,943,874 | A | 8/1999 | Maeda | |
| 6,199,388 | B1 | 3/2001 | Fischer | |
| 6,751,964 | B2 | 6/2004 | Fischer | |
| 6,945,324 | B2 | 9/2005 | Weng | |
| 6,976,524 | B2 * | 12/2005 | Walsh | F24F 11/84 62/177 |
| 7,886,986 | B2 | 2/2011 | Fischer | |
| 8,397,799 | B2 | 3/2013 | Blecker | |
| 9,625,222 | B2 | 4/2017 | Fischer | |
| 10,690,358 | B2 | 6/2020 | Fischer | |
| 11,054,167 | B2 * | 7/2021 | Furman | F24F 11/47 |
| 11,175,056 | B1 * | 11/2021 | Stevenson | F24F 11/74 |
| 11,320,161 | B2 | 5/2022 | Fischer | |
| 2008/0112128 | A1 | 5/2008 | Holland | |
| 2008/0116289 | A1 * | 5/2008 | Lochtefeld | F24F 11/84 236/44 C |
| 2010/0181062 | A1 | 7/2010 | McCann | |
| 2010/0236772 | A1 | 9/2010 | Novotny | |
| 2010/0242726 | A1 | 9/2010 | Enbom | |
| 2011/0155354 | A1 | 6/2011 | Karamanos | |
| 2013/0199772 | A1 * | 8/2013 | Fischer | F24D 3/02 165/96 |
| 2013/0240172 | A1 | 9/2013 | Reilly | |
| 2015/0369494 | A1 | 12/2015 | Kallesoe | |
| 2016/0169544 | A1 | 6/2016 | Fischer | |
| 2017/0299202 | A1 * | 10/2017 | Hancock | F24F 11/52 |
| 2018/0356108 | A1 * | 12/2018 | Eiermann | F24F 11/83 |

FOREIGN PATENT DOCUMENTS

| | | |
|---|---|---|
| EP | 1795825 | 6/2007 |
| JP | Hei 6-259146 | 9/1994 |
| JP | H0783466 | 3/1995 |
| JP | H09166346 | 6/1997 |
| JP | H09210426 | 8/1997 |
| JP | 2001-215037 | 8/2001 |
| JP | 2001215037 | 8/2001 |
| JP | 2004-03730 | 2/2004 |
| JP | 2008-309347 | 12/2008 |
| KR | 20100128374 | 12/2010 |
| KR | 10-2011-0038927 | 4/2011 |
| KR | 1020110038927 | 4/2011 |

OTHER PUBLICATIONS

Pinnacle Owner's Manual, SEMCO.
Pinnacle Chilled Beam Application Guide, SEMCO.
IAQ, Total Energy Recovery, Passive Dehumidification and Chilled Beam Technologies, SEMCO.
Federal Technology Alert, Two-Wheel Desiccant Dehumidification System, FEMP, US Dept. of Energy, Apr. 1997.
ASHRAE 1989, vol. 95, Part 2, Vancouver, CA, Two-Stage Desiccant Dehumidification in Commercial Building HVAC System, G. Meckler.
PTAB IPR Decision, Patent 6199388, Jul. 16, 2019.
Documents Cited & Disclosed for Pinnacle Patent 6199388.
Documents Cited & Disclosed for Parent U.S. Appl. No. 15/616,702.
JP2001-215037 "Ryobi", Machine Translation.
ISR and Written Opinion for Corresponding Int'l Application No. PCT/US2013/024401 dated Mar. 29, 2016.
Air Commodities Inc., Chilled Beam Design Guide. TROX Technik (TB20209) printed Oct. 13, 2011 See pp. 19-26.
ITT Corporation, Bell & Gossett Instruction Manual G95873, Rev. L, Circuit Setter Plus Balance Valves With NPT, Flanged and Solder Connections Aug. 1, 2009.
FlaktWoods, Precise Air Management. Product Range > Chilled Beams Sep. 1, 2008.
Taco Inc., LoFlo injection pumping Feb. 10, 2011.
Chilled Beam Design Guide, TROX Technik (TB031412).
Neuton Technical Guide, SEMCO, 2015.
Neuton Controlled Chilled Beam Pump Module, SEMCO, 2015.
EESR for EP 13744287.7.
TRO/TECHNIC Chilled Beam Design Guide.
Preliminary Rejection for corresponding Korean Patent Application No. 10-2014-7024596 that cites documents disclosed herein. Kim & Chang Cover Letter dated Mar. 25, 2019, Translation dated Mar. 14, 2019.

* cited by examiner

FIG. 1 – Multi-Zone Riser Configuration with Diverting Valve
(Pump operates continuously with at least 1 diverting valve)

Fig 3: Pre-Startup Balance Mode

Fig 4: Startup and Troubleshooting Mode (Steps 1 and 2)

Step 3

Step 4

MULTI-ZONE CHILLED BEAM SYSTEM AND METHOD WITH PUMP MODULE

RELATED PATENT APPLICATIONS

This patent application is non-provisional patent application of, and claims priority to, U.S. Provisional Patent Application Ser. No. 63,160,629, MULTI-ZONE CHILLED BEAM SYSTEM AND METHOD WITH PUMP MODULE, filed Mar. 12, 2021, having the same inventors and assignee. The contents of the priority provisional patent application are incorporated herein by reference.

FIELD OF THE INVENTION

This invention relates to heating, ventilating, and air conditioning (HVAC) systems and components and equipment for such systems, and to methods of configuring and controlling HVAC systems, including chilled-beam air conditioning systems. Various embodiments relate to multi-zone chilled-beam systems and methods, involve pump modules, including pump modules that serve multiple zones, or both. Some embodiments both cool and heat.

BACKGROUND OF THE INVENTION

Prior active and passive chilled-beam systems and methods, including systems and methods that include or use pump modules, are described in U.S. Pat. Nos. 9,625,222 and 10,060,638 and U.S. patent application Ser. No. 16/055,910, publication 20180372345 (U.S. Pat. No. 11,092,347, issued Aug. 17, 2021), U.S. Provisional Patent Application 61/594,231, and Patent Cooperation Treaty (PCT) patent application PCT/US13/24401, publication WO2013116695, all naming inventor John Fischer, which are all incorporated herein by reference. FlaktGroup SEMCO NEUTON Controlled Chilled Beam Pump Module, Owner's Manual, 2017, 2019, which was filed as part of the priority provisional patent application, further describes examples of pump modules, and is also incorporated herein by reference. Certain terms, however, may be used differently in the patents, patent applications, and other documents that are incorporated by reference, and where any inconsistencies exist between the documents that are incorporated by reference and the current patent application, the current patent application shall govern herein.

The prior art patents and patent applications identified above describe multiple-zone systems and methods with chilled beams and pump modules, but focus on systems and methods where each zone has its own pump module. Room for improvement exists over the prior art, including in the efficient utilization of pump modules, including in systems and methods where multiple zones are serviced by each pump module. Potential for benefit or improvement exists in these and other areas that may be apparent to a person of skill in the art having studied this document. Other needs or potential for benefit or improvement may also be known in the HVAC or control industries.

Figure 1:
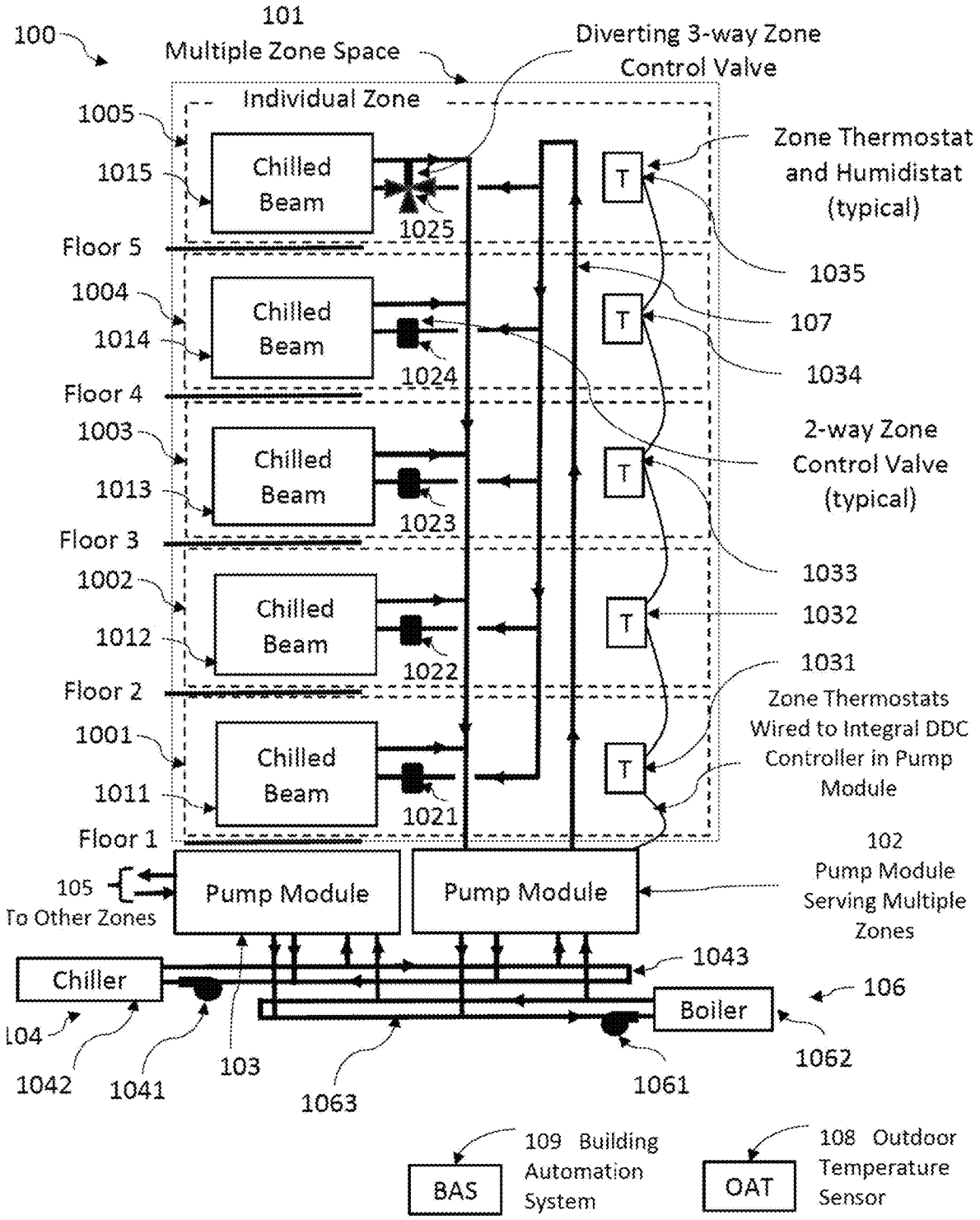
FIG. 1 is a block diagram illustrating an example of a multiple-zone air conditioning system cooling a multiple-zone space where the system includes multiple pump modules that each deliver chilled water to chilled beams in a plurality of the multiple zones.

These drawings illustrate, among other things, examples of certain components and aspects of particular embodiments of the invention. Other embodiments may differ. Various embodiments include components or aspects shown in the drawings, described in the specification, shown or described in documents that are incorporated by reference, known in the art, or a combination thereof. The drawings are not necessarily drawn to scale. Embodiments can include a sub-combination of the components shown in any particular drawing, components from multiple drawings, or both.

SUMMARY OF CERTAIN EXAMPLES OF EMBODIMENTS

This invention provides, among other things, various multiple-zone air conditioning systems, for example, for cooling a multiple-zone space, and various methods of controlling a chilled-beam air conditioning system, for instance, that cools a multiple-zone space. In various embodiments, a plurality of zones are served by each of multiple pump modules. Further, in a number of embodiments, the highest dewpoint in the zones served by a pump module is used to control water temperature delivered by that pump module to avoid condensation formation on the chilled beams. Various embodiments provide, for example, as an object or benefit, that they partially or fully address or satisfy one or more of the needs, potential areas for benefit, or opportunities for improvement described herein, or known in the art, as examples. Certain embodiments provide, for example, as objects or benefits, that they improve the performance of active or passive chilled-beam systems. Different embodiments simplify the design and installation of chilled-beam systems, reduce the installed cost, increase energy efficiency, or a combination thereof.

Specific embodiments include, for example, various multiple-zone air conditioning systems, for instance, for cooling a multiple-zone space. In a number of embodiments, the system has multiple zones. Further, in various embodiments, each zone has at least one chilled beam, a zone control valve, a zone thermostat, and a zone humidistat. In some embodiments, for example, the zone humidistat is integral with the zone thermostat. Still further, in a number of embodiments, each zone control valve controls whether chilled water is circulated through the (e.g., at least one) chilled beam within the zone (e.g., of the multiple zones) served by that zone control valve. Further still, in various embodiments, each zone thermostat measures temperature within the zone (e.g., of the multiple zones) that contains that thermostat. Even further, in a number of embodiments, each zone humidistat measures humidity, dew point, or a parameter that can be used to calculate humidity or dew point, within the zone that contains that humidistat. Even further still, in various embodiments, the air conditioning system includes multiple pump modules.

Further, in a number of embodiments, each pump module (e.g., of the multiple pump modules) includes a module pump, a water temperature sensor, a modulating valve, and a digital controller. Still further, in various embodiments, the module pump delivers the chilled water to the (e.g., at least one) chilled beam in a plurality of the multiple zones. Further still, in a number of embodiments, the water temperature sensor measures temperature of the chilled water delivered by the module pump to the (e.g., at least one) chilled beam in the plurality of the multiple zones served by the pump module (e.g., of the multiple pump modules). Even further, in various embodiments, the modulating valve controls temperature of the chilled water delivered from the pump module. Even further still, in a number of embodiments, the digital controller receives input from the zone thermostat in each of the plurality of the multiple zones that receive the chilled water from the pump module (e.g., of the multiple pump modules). Moreover, in various embodiments, the input from the zone thermostat includes: the temperature within the zone, and whether the zone thermostat calls for cooling. Furthermore, in a number of embodiments, the digital controller receives input from the zone humidistat in each of the plurality of the multiple zones that receive the chilled water from the pump module and controls the modulating valve to control the temperature of the chilled water delivered from the pump module to the plurality of the multiple zones. In addition, various embodiments, maintain the temperature of the chilled water at least a predetermined temperature differential above a maximum dewpoint within the plurality of the multiple zones that receive the chilled water from the pump module.

Still further, in a number of embodiments, the air conditioning system further includes a chilled-water distribution system, for example, that includes at least one chilled-water distribution pump, at least one chiller, and a chilled-water distribution loop. Even further, in various embodiments, the (e.g., at least one) chiller cools the chilled water and the (e.g., at least one) chilled-water distribution pump circulates the chilled water through the chilled-water distribution loop, for example, to each pump module (e.g., of the multiple pump modules) to be delivered by the module pump of each pump module to the (e.g., at least one) chilled beam of each zone (e.g., of the multiple zones).

In some embodiments, the maximum dewpoint is a highest dewpoint reported by the zone thermostat or the zone humidistat within the plurality of the multiple zones served by the pump module. Further, in certain embodiments, for each pump module (e.g., of the multiple pump modules), at least one zone control valve is a diverting valve, for example, that allows the chilled water to circulate through the module pump when flow of the chilled water through the (e.g., at least one) chilled beam is shut off at the zone control valve in all of the plurality of the multiple zones that receive the chilled water from the module pump. Still further, in some embodiments, for example, for each pump module, each zone control valve is controlled by the digital controller, for instance, using a temperature set point received from the zone thermostat in the zone served by the zone control valve. Even further, in particular embodiments, for instance, a particular zone control valve is open when a set point temperature is not satisfied in the zone served by the particular zone control valve. In contrast, in some embodiments, the particular zone control valve is closed when the set point temperature is satisfied in the zone served by the particular zone control valve. Further still, in a number of embodiments, for example, for each pump module of the multiple pump modules, locations of all of the plurality of the multiple zones that receive the chilled water from one pump module of the multiple pump modules are designed to have similar sensible load profiles.

Moreover, in particular embodiments, for example, for each pump module (e.g., of the multiple pump modules), when operating in a cooling mode, when a thermostat set point within the plurality of the multiple zones is not achieved within a preset time, speed of the module pump is increased to provide more cooling output. Furthermore, in some embodiments, for example, for each pump module (e.g., of the multiple pump modules), when a thermostat set point within the plurality of the multiple zones is not achieved when operating in a cooling mode, and the maximum dewpoint within the plurality of the multiple zones that receive the chilled water from the pump module of the multiple pump modules is more than a predetermined temperature differential below the temperature of the chilled water delivered from that pump module to the plurality of the multiple zones, then the temperature of the chilled water delivered from that pump module to the plurality of the multiple zones is lowered, for instance, until the maximum dewpoint within the plurality of the multiple zones that receive the chilled water from the pump module of the multiple pump modules is the predetermined temperature differential below the temperature of the chilled water delivered from that pump module to the plurality of the multiple zones.

Additionally, some embodiments include a hot-water distribution system. In certain embodiments, for example, the hot-water distribution system includes at least one hot water distribution pump, at least one water heater, and a hot water distribution loop. In particular embodiments, for example, the hot water distribution pump circulates the hot water through the hot water distribution loop to the multiple pump modules, for instance, to be delivered by the module pump of each pump module (e.g., of the multiple pump modules). Further, in some embodiments, for example, for each pump module, when any zones of the plurality of zones that are served by the pump module call for heat during a heating season, the hot water is supplied to the pump module. Still further, in particular embodiments, for instance, for each pump module (e.g., of the multiple pump modules), when some zones of the plurality of zones that are served by the pump module call for heat, and other zones of the plurality of zones that are served by the pump module call for cooling, the pump module alternates between delivering hot water and delivering chilled water, and the pump module determines whether the hot water or the chilled water is delivered by the pump module. Even further, in some embodiments, for example, for each pump module (e.g., of the multiple pump modules), when at least one zone of the plurality of zones served by the pump module calls for heat, and all other zones of the plurality of zones served by that pump module that are set for cooling are at set point, then the zone control valves of all satisfied zones of the plurality of zones are closed, and the pump module switches over from a cooling mode to a heating mode. In certain embodiments, this includes opening the zone control valve serving each zone of the plurality of zones served by the pump module that call for heat. This may occur, for example, after a delay to allow chilled water to leave distribution piping between the pump module and the chilled beams that are serviced by that pump module. Further still, in some such embodiments, the pump module operates in the heating mode for at least a minimum run time.

Furthermore, in some embodiments, when at least one zone (e.g., of the plurality of the multiple zones) served by a particular pump module (e.g., of the multiple pump modules) calls for heat, and all other zones (e.g., of the plurality of the multiple zones) served by the particular pump module that are set for cooling are at set point, then the particular pump module switches over from cooling to heating, for example, until at least one of the other zones (e.g., of the plurality of the multiple zones) served by the particular pump module that are set for cooling is no longer within a particular temperature differential of set point. Further, in particular embodiments, each pump module (e.g., of the multiple pump modules) controls speed of the module pump of the pump module including, when operating in a cooling mode, slowing the module pump of the pump module, for example, to reduce energy consumption of the module pump of the pump module. In certain embodiments, for example, this occurs when measured space temperature is at or below set-point temperature in all zones that are set for cooling of the plurality of zones served by the pump module. Still further, some embodiments include accelerating the module pump of the pump module to increase cooling capacity of at least one chilled beam served by the pump module by evening out temperature of the chilled beams in the plurality of zones served by the pump module. This may occur, for example, when measured space temperature in the zones is at least a predetermined temperature differential above the set-point temperature of the zone. Even further, in some embodiments, when a particular pump module (e.g., of the multiple pump modules) is operating with concurrent requests from zone thermostats for both heating and cooling in different zones of the plurality of zones served by the particular pump module, the module pump of the particular pump module is operated at a maximum speed. Even further still, in particular embodiments, the maximum speed is adjustable.

In various embodiments, determination of an operational mode of a (e.g., each) pump module (e.g., of the multiple pump modules) is set by a heating balance point of a building (e.g., space), for instance, containing the multiple-zone air conditioning system. Further, in some embodiments, determination of the operational mode of each pump module (e.g., of the multiple pump modules) is based upon outdoor air temperature. Further, in some (e.g., other) embodiments, determination of the operational mode of a particular pump module is based upon relative quantity of heating and cooling requests made by the zone thermostats, for example, within the plurality of the multiple zones served by the particular pump module. Still further, in particular embodiments, for example, when outdoor air temperature is below a predetermined balance point condition, the building automation system provides a first global command, for instance, to each pump module to operate in a heating priority mode. Similarly, in certain embodiments, when the outdoor air temperature is above the predetermined balance point condition, the building automation system provides a second global command to each pump module (e.g., of the multiple pump modules) to operate in a cooling priority mode. Further still, in some embodiments, when a majority of zones (e.g., of the plurality of the multiple zones) served by a particular pump module have called for heating over a preceding period of time, for example, without calling for cooling, the particular pump module converts to a heating priority mode. Similarly, in particular embodiments, for example, when a majority of the zones (e.g., of the plurality of the multiple zones) served by the particular pump module (e.g., of the multiple pump modules) have called for cooling over the preceding period of time, for instance, without calling for heating, the particular pump module converts to a cooling priority mode. Even further, in a number of embodiments, when set point is satisfied for all zone thermostats in all zones (e.g., of the plurality of the multiple zones) served by a particular pump module (e.g., of the multiple pump modules), the module pump for the particular pump module is off (e.g., turned off).

In particular embodiments, the digital controller, for instance, of each pump module is programmed to support installation commissioning, troubleshooting, ongoing performance monitoring, or a combination thereof. Further, in some embodiments, alarms are shown locally at the pump module (e.g., at the digital controller), the alarms are sent (e.g., by the digital controller) to the building automation system, or both. Further still, in some embodiments, for example, when a particular zone control valve is showing an open status, but water temperature leaving the module pump of the pump module (e.g., of the multiple pump modules) serving the particular zone control valve is hotter than a cooling set point from the zone thermostat of the zone served by the particular zone control valve, the module pump is reported to be dead-heading. This may occur, for example, in embodiments where all zone control valves are two-way valves rather than having at least one diverting 3-way valve.

In some embodiments, when a particular zone (e.g., of the multiple zones) is not being conditioned despite a call for the zone control valve for the particular zone to be open, an alarm reporting failure of the zone control valve for the particular zone is reported. Further, in certain embodiments, when a first zone (e.g., of the plurality of the multiple zones) served by a particular pump module (e.g., of the multiple pump modules) is calling for heating, but is not responding, while a second zone (e.g., of the plurality of the multiple zones) served by the particular pump module is overheating, an alarm is reported indicating cross wiring. Still further, in some embodiments, when a first zone (e.g., of the plurality of the multiple zones) served by a particular pump module (e.g., of the multiple pump modules) is calling for cooling, but is not responding, while a second zone of the plurality of the multiple zones served by the particular pump module is overcooling, an alarm is reported indicating cross wiring. Even further, in particular embodiments, when a dewpoint in a particular zone (e.g., of the multiple zones) exceeds a dewpoint threshold, a particular pump module (e.g., of the multiple pump modules) that serves the particular zone closes the zone control valve for the particular zone. Even further still, in some embodiments, when a dewpoint in a particular zone (e.g., of the plurality of the multiple zones) exceeds a dewpoint threshold for a preset time period, the pump module (e.g., of the multiple pump modules) that serves the particular zone sends an alarm to the building automation system, for instance, that the particular zone is out of humidity control and should be checked. In addition, various other embodiments of the invention are also described herein, and other benefits of certain embodiments may be apparent to a person of ordinary skill in the art.

DETAILED DESCRIPTION OF EXAMPLES OF EMBODIMENTS

Various air conditioning systems for cooling a multiple-zone space, and methods for controlling such systems, include, use, or concern multiple pump modules that each serve a plurality of zones. Many embodiments include or use chilled beams. Various projects, for example, like offices, schools, and hotels, may benefit (e.g., substantially) from using (e.g., chilled-beam) pump modules that each serve multiple zones. In a number of embodiments, zones served by one pump module may be designed or chosen to have similar load profiles, for example. Further, in various embodiments, each zone (e.g., office or hotel room), which is heated, cooled, or both, (e.g., with a chilled-beam system), is fitted with a (e.g., room) thermostat, humidistat, or both (e.g., a smart thermostat), for example, so that each zone can report the temperature, humidity, or both, for instance, at any point in time. Still further, in some embodiments, the thermostats report (e.g., any) heating or cooling requests (e.g., thermostat settings, set point, or both). Various embodiments include or use a combination temperature and humidity sensor (e.g., in each zone). Even further, in a number of embodiments, the (e.g., zone) sensor(s) are connected to a DDC controller, for example, integral to the pump module (e.g., serving that zone). Further still, in various embodiments, the (e.g., zone) sensor(s) are connected to a main building automation system (BAS), for example, which, in some embodiments, also feeds data to the pump module(s), for instance, serving multiple groups of zones. These connections, in various embodiments, can be wired connections, for example, daisy-chained, for instance, thought a series of (e.g., "smart") room sensors, or can be accomplished wirelessly, as examples.

Various embodiments are or include, for example, a multiple-zone air conditioning system, for instance, for cooling a multiple-zone space. Referring to the drawings, FIG. 1 shows, for example, multiple-zone air conditioning system 100 for cooling multiple-zone space 101. In the embodiment shown, for instance, multiple-zone air conditioning system 100 serves or includes multiple zones 1001, 1002, 1003, 1004, and 1005. In the embodiment illustrated, each zone (e.g., 1001 to 1005) of the multiple zones (e.g., space 101) includes at least one chilled beam (e.g., 1011, 1012, 1013, 1014, and 1015). Further, in the embodiment illustrated, each zone (e.g., 1001 to 1005) of the multiple zones (e.g., space 101) includes a zone control valve (e.g., 1021, 1022, 1023, 1024, and 1025), for instance, that controls whether chilled water is circulated through the at least one chilled beam (e.g., 1011 to 1015) within the zone (e.g., 1001 to 1005) of the multiple zones (e.g., space 101). In the embodiment illustrated, each zone (e.g., 1001 to 1005) of the multiple zones (e.g., space 101) further includes a zone thermostat (e.g., 1031, 1032, 1033, 1034, and 1035), for example, that measure temperature within the zones (e.g., 1001 to 1005) of the multiple zones (e.g., space 101). Further still, in various embodiments, each zone (e.g., of the multiple zones) includes a zone humidistat measuring (e.g., within the zone of the multiple zones) humidity, dew point, or a parameter that can be used to calculate humidity or dew point (e.g., within each zone). Even further, in a number of embodiments, the thermostats include, or serve as, such humidistats. In the embodiment illustrated, for example, zone thermostats 1031 to 1035 are also zone humidistats. Further, various embodiments (e.g., of a multiple-zone air conditioning system, for instance, for cooling a multiple-zone space) include multiple pump modules. For example, in the embodiment illustrated, multiple-zone air conditioning system 100 for cooling multiple-zone space 101 includes pump modules 102 and 103. In the embodiment shown, pump module 102 serves zones 1001 to 1005 and chilled beams 1011 to 1015, and pump module 103 serves other zones (e.g., 105), which are not shown. Further, in many embodiments, the multiple pump modules may include more than two pump modules.

Figure 2:
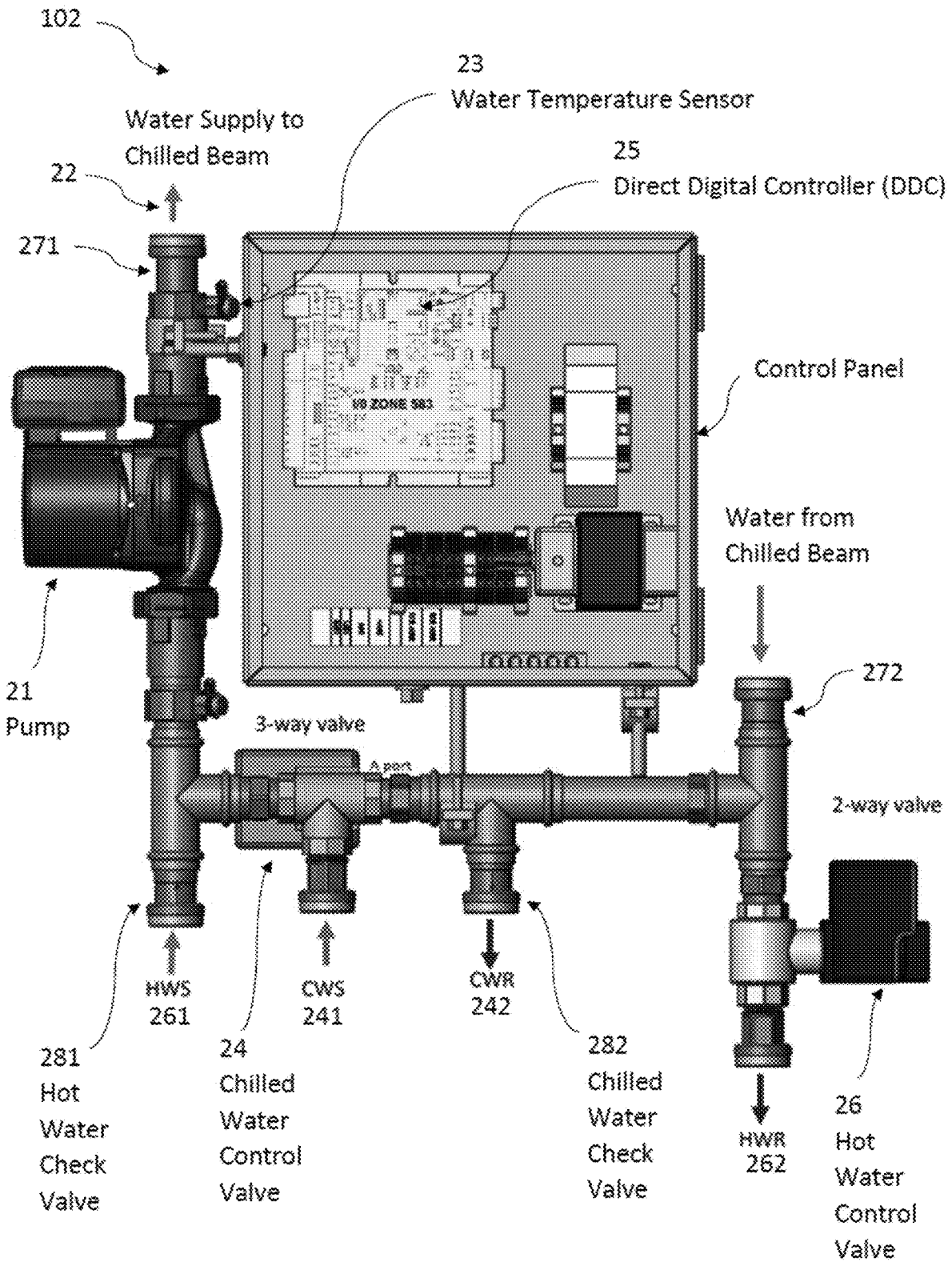
FIG. 2 illustrates an example of a pump module, that may be used, for example, to deliver chilled water to chilled beams in a plurality of the multiple zones served by the air conditioning system of FIG. 1.

FIG. 2 is a detailed view of pump module 102, which is an example of a pump module. Pump module 103 shown on FIG. 1 may be similar or identical. In various embodiments, each pump module (e.g., of the multiple pump modules) includes a module pump, for example, that delivers chilled water to the at least one chilled beam in a plurality of multiple zones. In the embodiment shown, for example, pump module 102 includes module pump 21 that delivers chilled water 22 to the chilled beams (e.g., 1011 to 1015) in a plurality of the multiple zones (e.g., 1001 to 1005). In a number of embodiments, for example, the plurality of zones served by one pump module is a subset of the larger set of multiple zones served by the air conditioning system (e.g., 100). For example, in the embodiment illustrated in FIG. 1, pump module 103 serves other zones 105 that are not shown. In FIG. 2, pump module 102 also includes water temperature sensor 23 that measures temperature of chilled water 22 delivered by module pump 21 to the chilled beams (e.g., at least one chilled beam, for instance, 1011 to 1015) in the plurality (e.g., 5 shown in FIG. 1, namely, 1001 to 1005) of the multiple zones (e.g., 1001 to 1005) served by pump module 102 of the multiple pump modules (e.g., 102 and 103). Further, in the embodiment shown, pump module 102 includes chilled water control valve or modulating valve 24 that controls temperature of chilled water 22 delivered from pump module 102 of the multiple pump modules (e.g., 102 and 103 shown in FIG. 1). FIG. 2 also shows digital controller 25, that is part of pump module 102. In many embodiments, each pump module (e.g., 102 and 103) includes a digital controller (e.g., as well as other components shown or described herein for pump module 102).

In a number of embodiments, the digital controller (e.g., 25 of pump module 102) receives input from the zone thermostat (e.g., 1031 to 1035 shown in FIG. 1) in each of the plurality (e.g., 1001 to 1005) of the multiple zones (e.g., 1001 to 1005) that receive the chilled water (e.g., 22) from the pump module (e.g., 102) of the multiple pump modules (e.g., 102 and 103). Further, in various embodiments, the input from the zone thermostat (e.g., 1031 to 1035) includes the temperature within the zone (e.g., one of zones 1001 to 1005) of the multiple zones (e.g., zones 1001 to 1005 or space 101), and whether the zone thermostat calls for cooling, or both. For instance, in the embodiment illustrated, the input from zone thermostat 1031 includes the temperature within zone 1001 of multiple zones 1001 to 1005, and whether zone thermostat 1031 calls for cooling. Further, as another example, the input from zone thermostat 1032 includes the temperature within zone 1002 of multiple zones 1001 to 1005, and whether zone thermostat 1032 calls for cooling. The same may be true for the other zone thermostats and zones. Still further, in the embodiment illustrated, the digital controller (e.g., 25) receives input from the zone humidistat (e.g., one of 1031 to 1035) in each of the plurality (e.g., 1001 to 1005) of the multiple zones e.g., 1001 to 1005) that receive the chilled water (e.g., 22) from the pump module (e.g., 102) of the multiple pump modules (e.g., 102 and 103). As mentioned, in the embodiment shown, the zone humidistats are integral with the zone thermostats (e.g., 1031 to 1035). In various embodiments, each zone thermostat, zone humidistat, or both, reports (e.g., to the digital controller 25 of the serving pump module) conditions, set point, or both, within the zones in which they are located. Even further, in the embodiment illustrated, digital controller 25 controls modulating valve 24 to control the temperature of chilled water 22 delivered from pump module 102 of the multiple pump modules (e.g., 102 and 103) to the plurality (e.g., 1001 to 1005) of the multiple zones (e.g., 1001 to 1005). Even further still, in a number of embodiments, this includes maintaining the temperature of chilled water 22 at least a predetermined temperature differential (e.g., ½, 1, 2, or 3 degrees F. or C.) above a maximum dewpoint within the plurality (e.g., 1001 to 1005) of the multiple zones (e.g., 1001 to 1005) that receive the chilled water (e.g., 22) from the pump module (e.g., 102) of the multiple pump modules (e.g., 102 and 103).

Referring again to FIG. 1, in the embodiment shown, multiple-zone air conditioning system 100 for cooling multiple-zone space 101 further includes chilled-water distribution system 104 that includes at least one chilled-water distribution pump (e.g., 1041), at least one chiller (e.g., 1042), and a chilled-water distribution loop (e.g., 1043). In the embodiment shown, the at least one chiller (e.g., 1042) cools the chilled water (e.g., in loop 1043, which eventually mixes with water returning from the chilled beams and becomes chilled water 22 shown in FIG. 2). Further, in the embodiment illustrated, the at least one chilled-water distribution pump (e.g., 1041) circulates the chilled water through the chilled-water distribution loop (e.g., 1043) to each pump module (e.g., each of 102 and 103) of the multiple pump modules (e.g., 102 and 103) to be delivered by the module pump (e.g., 21) of each pump module (e.g., 102) of the multiple pump modules (e.g., 102 and 103) to the at least one chilled beam (e.g., each of 1011 to 1015) of each zone (e.g., each of 1001 to 1005) of the multiple zones (e.g., 1001 to 1005 or space 101).

In various embodiments, the zone control valves (e.g., 1021 to 1025) are controlled by the digital controller (e.g., 25) of the pump module (e.g., 102) that serves those zones (e.g., 1001 to 1005). Further, in some embodiments, the maximum dewpoint is a highest dewpoint reported by the zone thermostat or the zone humidistat within the plurality of the multiple zones served by the pump module of the multiple pump modules. For example, in the embodiment illustrated, the maximum dewpoint is the highest dewpoint reported by (e.g., any, or any that are calling for cooling) of zone thermostats 1031 to 1035, which also serve as zone humidistats within the plurality (e.g., 1001 to 1005) of the multiple zones (e.g., 1001 to 1005) served by pump module 102 of the multiple pump modules (e.g., 102 and 103). As used herein, in this context, "reported" includes reporting dewpoints calculated from one or more measurements reported by the thermostats, humidistats, or both. In some such embodiments, the thermostat and the humidistat are included within the same assembly (e.g., one of 1031 to 1035 as shown), while in other embodiments, the thermostat and the humidistat are separate assemblies (e.g., not shown).

In some embodiments, for each pump module (e.g., of multiple pump modules), at least one zone control valve is a diverting valve that allows the chilled water to circulate through the module pump when flow of the chilled water through the at least one chilled beam is shut off at the zone control valve in all of the plurality of the multiple zones that receive the chilled water from the module pump. FIG. 1 shows an example where multiple-zone air conditioning system 100 includes zone control valve 1025 that is a diverting valve that allows the chilled water (e.g., 22 shown in FIG. 2) to circulate through the module pump (e.g., 21) when flow of the chilled water through the at least one chilled beam (e.g., 1011 to 1015) is shut off at the zone control valve (e.g., 1021 to 1025) in all of the plurality (e.g., 1001 to 1005) of the multiple zones (e.g., 1001 to 1005) that receive the chilled water from that module pump (e.g., 21). In this embodiment, diverting valve 1025 allows chilled water 22 (shown in FIG. 2) to circulate through module pump 21 when flow of chilled water 22 through all of the chilled beams (i.e., 1011 to 1015) is shut off at all of zone control valves 1021 to 1025 in all of zones 1001 to 1005 that receive chilled water 22 from module pump 21. In some embodiments, for example, this is the case for each pump module (e.g., 103 as well as 102) of the multiple pump modules (e.g., 102 and 103). Moreover, in various (e.g., other) embodiments, when the set point is satisfied for all zone thermostats (e.g., 1031 to 1035) in all zones (e.g., 1001 to 1005) of the plurality of the multiple zones served by a particular pump module (e.g., 102) of the multiple pump modules, the module pump (e.g., 21) for the particular pump module (e.g., 102) is off (e.g., is turned off by digital controller 25). In this context, as used herein, the set point is considered to be satisfied if the air conditioning system (e.g., 100) is turned off at that zone thermostat as well as if the thermostat set point is satisfied. Further, in some embodiments where the zone pump is turned off when all zone thermostats are satisfied that are in zones served by that zone pump, no diverting valve is needed. In such embodiments, all zone control valves (e.g., 1021 to 1025) may be two-way valves, for example, as shown in FIG. 1 for zone control valves 1021 to 1024. In such embodiments, since the module pump (e.g., 21) is off when all zone control valves (e.g., 1021 to 1025) are closed, at least if everything is working properly, the module pump (e.g., 21) cannot dead head against closed valves even if none of the zone control valves (e.g., 1021 to 1025) is a diverting valve (e.g., a diverting valve being shown in FIG. 1 for zone control valve 1025).

Further, in a number of embodiments, for instance, for each pump module (e.g., 102) of the multiple pump modules (e.g., 102 and 103) each zone control valve (e.g., each of valves 1021 to 1025) is controlled by the digital controller (e.g., 25) using a temperature set point received from the zone thermostat (e.g., 1031 to 1035) in the zone (e.g., one of zones 1001 to 1005) of the multiple zones (e.g., 1001 to 1005) served by the zone control valve (e.g., one of valves 1021 to 1025). In this context, as used herein, the zone control valve serves the same zone that the zone thermostat is in that provides the temperatures set point. For example, in the embodiment illustrated, for pump module 102, zone control valve 1021 is controlled by digital controller 25 using a temperature set point received from zone thermostat 1031 in zone 1001, which is served by zone control valve 1021. Still further, in various embodiments, for example, for each zone control valve (e.g., each of valves 1021 to 1025), a particular zone control valve (e.g., 1021) is open when a set point temperature is not satisfied in the zone (e.g., 1001) served by the particular zone control valve (i.e., 1021). Even further, in some embodiments, the particular zone control valve (e.g., 1021) is closed when the set point temperature is satisfied in the zone (e.g., 1001) served by the particular zone control valve (i.e., 1021, for instance, of the "each zone control valve").

Still further, in various embodiments, for instance, for each pump module (e.g., 102) of the multiple pump modules (e.g., 102 and 103), locations of all of the plurality of the multiple zones (e.g., 1001 to 1005) that receive the chilled water (e.g., 22) from the pump module (e.g., 102) are designed to have similar sensible load profiles. For example, in particular embodiments, (e.g., all) of the plurality of the multiple zones (e.g., 1001 to 1005) that receive the chilled water (e.g., 22) from the pump module (e.g., 102) are on a common side of the building (e.g., space 101) that contains the multiple-zone air conditioning system (e.g., 100), are of substantially the same size, have substantially the same size (e.g., area) windows, have substantially the same internal sensible loads (e.g., lighting), have substantially the same shading, or a combination thereof. As used herein, unless indicated otherwise, "substantially" means to within 20 percent and "similar" means to within 30 percent. Where "substantially the same" is mentioned herein, in other embodiments, the parameters (e.g., size) are "similar". Further, as used herein, "designed" in this context includes being selected for the indicated purpose, as well as being configured or constructed (e.g., with such common features). In certain embodiments, for example, the plurality of zones served by one pump module is a stack of similar or equal size rooms on different floors of a multi-story building. In FIG. 1, for example, zones 1001 to 1005, served by pump module 102, are on floors 1 to 5 of the building (e.g., containing multiple-zone space 101).

Even further, in some embodiments, (e.g., of a multiple-zone air conditioning system, for example, 100), for instance, for each pump module (e.g., 102) of the multiple pump modules (e.g., 102 and 103), when operating in a cooling mode, when a thermostat set point within the plurality of the multiple zones (e.g., zones 1001 to 1005) is not achieved within a preset time (e.g., measured in minutes), speed of the module pump (e.g., 21) is increased to provide more cooling output. In particular embodiments, for example, the thermostat set point may be provided by any one of the zone thermostats (e.g., 1031 to 1035) of a zone (e.g., 1001 to 1005) within the plurality of the multiple zones (e.g., 1001 to 1005). In certain embodiments, for instance, one zone served by a pump module may trigger the increase in speed of the module pump. Examples of the "preset time" include 10, 15, 20, 30, 45, or 60 minutes, which may be selectable or adjustable, for example, at the digital controller (e.g., 25. Even further still, in particular embodiments, (e.g., for each pump module of the multiple pump modules), when a thermostat set point within the plurality of the multiple zones (e.g., 1001 to 1005) is not achieved when operating in a cooling mode, and the maximum dewpoint within the plurality of the multiple zones that receive the chilled water (e.g., 22) from the pump module (e.g., of the multiple pump modules) is more than a predetermined temperature differential (e.g., ½, 1, 2, or 3 degrees F. or C.) below the temperature of the chilled water (e.g., 22) delivered from the pump module (e.g., 102, for instance, of the multiple pump modules) to the plurality of the multiple zones (e.g., 1001 to 1005), then the temperature of the chilled water (e.g., 22) delivered from the pump module (e.g., 102) to the plurality of the multiple zones (e.g., 1001 to 1005) is lowered, for example, until the maximum dewpoint within the plurality of the multiple zones (e.g., 1001 to 1005) that receive the chilled water from the pump module (e.g., 102, for instance, of the multiple pump modules) is the predetermined temperature differential below the temperature of the chilled water (e.g., 22) delivered from the pump module (e.g., 102) to the plurality of the multiple zones (e.g., 1001 to 1005). In some embodiments, one zone served by a pump module (e.g., 102) may trigger the change (e.g., decrease) in temperature of the chilled water (e.g., 22). This may be controlled by the digital controller (e.g., 25), for example.

In some embodiments, the multiple-zone air conditioning system includes a hot-water distribution system. In the embodiment shown, for example, multiple-zone air conditioning system 100 includes hot-water distribution system 106 shown in FIG. 1. In the embodiment illustrated, hot-water distribution system 106 includes hot water distribution pump 1061, boiler or water heater 1062, and hot water distribution loop 1063. In various embodiments, the hot-water distribution system includes at least one hot water distribution pump (e.g., 1061), at least one water heater (e.g., 1062), and a hot water distribution loop (e.g., 1063). Further, in a number of embodiments, the at least one water heater (e.g., 1062) heats hot water, and the hot water distribution pump (e.g., 1061) circulates the hot water through the hot water distribution loop (e.g., 1063), for example, to the multiple pump modules (e.g., 102 and 103), for instance, to be delivered by the module pump (e.g., 21) of each pump module (e.g., 102) of the multiple pump modules (e.g., 102 and 103). Still further, in some embodiments, for instance, for each pump module (e.g., 102) of the multiple pump modules (e.g., 102 and 103), when any zones of the plurality of zones (e.g., 1001 to 1005) that are served by the pump module (e.g., 102) call for heat during a heating season, the hot water (e.g., described in this paragraph) is supplied to the pump module (e.g., 102) of the multiple pump modules. In this context, the "heating season" may be determined by the calendar (e.g., including all or part of winter) or may be determined by outdoor air temperature (e.g., measured at sensor 108), as examples.

In particular embodiments, for example, for each pump module (e.g., 102) of the multiple pump modules (e.g., 102 to 103), when some zones (e.g., one or more of zones 1001 to 1005) of the plurality of zones (e.g., 1001 to 1005) that are served by the pump module (e.g., 102) call for heat (e.g., at some of zone thermostats 1031 to 1035), and other zones (e.g., one or more other zones of zones 1001 to 1005) of the plurality of zones that are served by the pump module (e.g., 102) call for cooling (e.g., at other of zone thermostats 1031 to 1035), the pump module (e.g., 102) of the multiple pump modules (e.g., 102 and 103) alternates (e.g., strategically) between delivering hot water (e.g., from hot-water distribution system 106) and delivering chilled water (e.g., from chilled-water distribution system 104). In some such embodiments, for example, the pump module (e.g., 102, for instance, at digital controller 25) determines whether the hot water or the chilled water is delivered by the pump module (e.g., 102). For instance, the pump module may alternate between heating and cooling for time periods sufficient to meet or approach the temperature set points, for example, in all zones served by the pump module. Where achieving all set points is not possible, the pump module may alternate to meet as many set points as possible while providing at least some heating or cooling to each zone, as requested, over a period of time. In some embodiments, for example, (e.g., for each pump module of the multiple pump modules) when at least one zone (e.g., 1001) of the plurality of zones (e.g., 1001 to 1005) served by the pump module (e.g., 102) calls for heat, and all other zones (e.g., 1002 to 1004) of the plurality of zones (e.g., 1001 to 1005) served by that pump module (e.g., 102) that are set for cooling (e.g., where zones 1002 to 1004 are set for cooling at thermostats 1032 to 1034 and zone thermostat 1035 of zone 1005 is turned off) are at set point, then the zone control valves (e.g., 1022 to 1024) of all satisfied zones (e.g., 1002 to 1004) of the plurality of zones (e.g., 1001 to 1005) are closed. In a number of embodiments, the pump module (e.g., 102) then switches over from a cooling mode (e.g., taking chilled water from chilled-water distribution system 104) to a heating mode (e.g., taking hot water from hot-water distribution system 106). This may include, for example, opening the zone control valve (e.g., 1021) serving each zone (e.g., 1001) of the plurality of zones (e.g., 1001 to 1005) served by the pump module (e.g., 102) of the multiple pump modules (e.g., 102 and 103) that call for heat. In particular embodiments, for instance, this switch may take place after a delay, for example, to allow chilled water to leave distribution piping (e.g., 107) between the pump module (e.g., 102) and the chilled beams (e.g., 1011 to 1015) that are serviced by the pump module (e.g., 102). Further, in certain embodiments, the pump module (e.g., 102) may operate in the heating mode (e.g., taking hot water from hot-water distribution system 106) for at least a minimum run time (e.g., 5, 10, 15, 20, or 30 minutes, which may be selectable or adjustable).

In certain embodiments, when at least one zone (e.g., 1001) of the plurality of the multiple zones (e.g., 1001 to 1005) served by a particular pump module (e.g., 102) calls for heat (e.g., at thermostat 1031 for zone 1001), and all other zones (e.g., 1002 to 1004 in this example) of the plurality of the multiple zones (e.g., 1001 to 1005) served by the particular pump module (e.g., 102) that are set for cooling are at set point, then the particular pump module (e.g., 102) switches over (e.g., as controlled by digital controller 25) from cooling (e.g., taking chilled water from chilled-water distribution system 104) to heating (e.g., taking hot water from hot-water distribution system 106) until at least one of the other zones (e.g., one of zones 1002 to 1004, as reported by zone thermostats 1032 to 1034) of the plurality of the multiple zones (e.g., 1001 to 1005) served by the particular pump module (e.g., 102) that are set for cooling is no longer within a particular temperature differential (e.g., 1, 2, 3, or 4 degrees F. or C.) of set point.

In various embodiments, each pump module (e.g., 102) of the multiple pump modules (e.g., 102 and 103 shown) controls speed of the module pump (e.g., 21) of the pump module (e.g., 102). In certain embodiments, for example, this includes, for example, when operating in a cooling mode (e.g., taking chilled water from chilled-water distribution system 104), slowing the module pump (e.g., 21) of the pump module (e.g., 102), for instance, to reduce energy consumption of the module pump (e.g., 21) when measured space temperature (e.g., measured by some or all of zone thermostats 1031 to 1035) is at or below set-point temperature (e.g., reported by some or all of zone thermostats 1031 to 1035) in all zones of the plurality of zones (e.g., 1001 to 1005) served by the pump module (e.g., 102) that are set for cooling (e.g., set at some or all of zone thermostats 1031 to 1035). Further, in particular embodiments, the pump module (e.g., 102, for instance, via digital controller 25) accelerates the module pump (e.g., 21) of the pump module (e.g., 102) to increase cooling capacity of at least one chilled beam (e.g., 1011 to 1015) served by the pump module (e.g., 102) by evening out temperature of the at least one chilled beam (e.g., 1011 to 1015, where control valves 1021 to 1025 are open) in of the plurality of zones (e.g., 1001 to 1005) served by the pump module (e.g., 102). This increase in pump speed may take place, for example, when measured space temperature (e.g., measured by one or more of zone thermostats 1031 to 1035) in the zone of the plurality of zones (e.g., 1001 to 1005) containing the at least one chilled beam (e.g., 1011 to 1015) is at least a predetermined temperature differential above the set-point temperature (e.g., reported by one of zone thermostats 1031 to 1035) of the zone (e.g., one of zones 1001 to 1005) of the plurality of zones (e.g., 1001 to 1005) containing the at least one chilled beam (e.g., 1011 to 1015).

In some embodiments, when a particular pump module (e.g., 102, for example, of the multiple pump modules) is operating with concurrent requests from zone thermostats (e.g., 1031 to 1035) for both heating and cooling in different zones (e.g., different ones of zones 1001 to 1005) of the plurality of zones (e.g., 1001 to 1005) served by the particular pump module (e.g., 102), the module pump (e.g., 21) of the particular pump module (e.g., 102) is operated (e.g., by digital controller 25) at a maximum speed. In certain embodiments, for instance, the maximum speed is adjustable (e.g., at digital controller 25). Further, in some embodiments, determination (e.g., at digital controller 25) of an operational mode (e.g., heating or cooling) of each pump module (e.g., 102) of the multiple pump modules (e.g., 102 and 103) is set by a heating balance point of a building (e.g., defining space 101) containing the multiple-zone air conditioning system (e.g., 100). Further, in various embodiments, determination of the operational mode (e.g., of each pump module, for instance, 102) is based upon outdoor air temperature (e.g., measured by an outdoor air temperature sensor, for instance, 108). In certain embodiments, however, determination of the operational mode (e.g., heating or cooling) of a particular pump module (e.g., 102) of the multiple pump modules is based upon relative quantity of heating and cooling requests made by the thermostats (e.g., 1031 to 1035) within the plurality of the multiple zones (e.g., 1001 to 1005) served by the particular pump module (e.g., 102), as another example. Further, in some embodiments, when outdoor air temperature (e.g., measured by temperature sensor 108) is below a predetermined balance point condition, a building automation system (e.g., 109) provides a first global command, for instance, to each pump module (e.g., 102) of the multiple pump modules (e.g., 102 and 103) to operate in a heating priority mode. Still further, in particular embodiments, when the outdoor air temperature (e.g., reported by sensor 108) is above the predetermined balance point condition, the building automation system (e.g., 109) provides a second global command to each pump module (e.g., 102, for example, of the multiple pump modules) to operate in a cooling priority mode. Even further, in some (e.g., other) embodiments, when a majority of zones (e.g., a majority of zones 1001 to 1005) of the plurality of the multiple zones (e.g., 1001 to 1005) served by a particular pump module (e.g., 102) of the multiple pump modules (e.g., 102 and 103) have called for heating (e.g., at a majority of zone thermostats 1031 to 1035) over a preceding period of time, without calling for cooling, the particular pump module (e.g., 102) converts to a heating priority mode. Even further still, in some (e.g., such) embodiments, when a majority of the zones (e.g., a majority of zones 1001 to 1005, for instance, via thermostats 1031 to 1035) of the plurality of the multiple zones (e.g., 1001 to 1005) served by the particular pump module (e.g., 102) of the multiple pump modules have called for cooling over the preceding period of time, for instance, without calling for heating, the particular pump module converts to a cooling priority mode. For example, this "preceding period of time" may be 1, 1.5, 2, 2.5, 3, 4, 5, 6, 8, 12, or 24 hours, as examples.

In a number of embodiments, the digital controller (e.g., 25), for example, of each pump module of the multiple pump modules (e.g., 102 and 103) is programmed to support installation commissioning, troubleshooting, ongoing performance monitoring, or a combination thereof, for instance, by showing alarms, for example, locally at the pump module (e.g., at digital controller 25), by sending the alarms to a building automation system (e.g., 109), or both. See, for instance, FIGS. 3-8. In certain embodiments, for example, when a particular zone control valve (e.g., one of valves 1021 to 1025, for instance, 1021) is showing an open status, but water (e.g., 22) temperature (e.g., at temperature sensor 23) leaving the module pump (e.g., 21) of the pump module (e.g., 102) serving the particular zone control valve (e.g., 1021) is hotter than a cooling set point from the zone thermostat (e.g., 1031) of the zone (e.g., 1001) served by the particular zone control valve (e.g., 1021), the module pump (e.g., 102) is reported, for instance, to be dead-heading. In various embodiments, alarms may be reported, for example, at digital controller 25, building automation system (BAS) 109, or both). Further, in some embodiments, when a particular zone (e.g., 1001) of the multiple zones (e.g., 1001 to 1005) is not being conditioned (e.g., as determined by temperature measurements from the zone thermostat, for example, 1031) despite a call (e.g., from thermostat 1031, controller 25, or both) for the zone control valve (e.g., 1021) for the particular zone (e.g., 1001) to be open, an alarm reporting failure of the zone control valve (e.g., 1021) for the particular zone (e.g., 1001) is reported (e.g., at digital controller 25, BAS 109, or both). Still further, in some embodiments, when a first zone (e.g., 1001) of the plurality of the multiple zones (e.g., 1001 to 1005) served by a particular pump module (e.g., 102) of the multiple pump modules (e.g., 102 and 103) is calling (e.g., at zone thermostat 1031) for heating, but is not responding (e.g., as reported by zone thermostat 1031), while a second zone (e.g., 1002) of the plurality of the multiple zones (e.g., 1001 to 1005) served by the particular pump module (e.g., 102) is overheating (e.g., as reported by zone thermostat 1032), an alarm is reported, for example, indicating cross wiring (e.g., between zone control valves 1021 and 1022). Even further, in some embodiments, when a first zone (e.g., 1001) of the plurality of the multiple zones (e.g., 1001 to 1005) served by a particular pump module (e.g., 102) of the multiple pump modules (e.g., 102 and 103) is calling for cooling (e.g., through zone thermostat 1031), but is not responding (e.g., as reported by zone thermostat 1031), while a second zone (e.g., 1002) of the plurality of the multiple zones (e.g., 1001 to 1005) served by the particular pump module (e.g., 102) is overcooling (e.g., as reported by zone thermostat 1032), an alarm is reported, for example, indicating cross wiring (e.g., between zone control valves 1021 and 1022). Even further still, in some embodiments, when a dewpoint (e.g., reported by zone thermostat 1031, which is also a humidistat) in a particular zone (e.g., 1001) of the multiple zones (e.g., 1001 to 1005) exceeds a dewpoint threshold (e.g., 58 to 60 degrees F., for instance, adjustable in some embodiments), a particular pump module (e.g., 102) of the multiple pump modules (e.g., 102 and 103) that serves the particular zone (e.g., 1001) closes (e.g., controlled by digital controller 25) the zone control valve (e.g., 1021) for the particular zone (e.g., 1001). In such embodiments, digital controller 25 may then stop using the dewpoint in that zone (e.g., 1001, as reported by zone thermostat 1031) to determine the temperature of chilled water 22 (e.g., controlled by modulating chilled water control valve 24). Moreover, in some (e.g., such) embodiments, when a dewpoint in a particular zone (e.g., 1001) of the plurality of the multiple zones (e.g., 1001 to 1005) exceeds the dewpoint threshold for a preset time period (e.g., 30 to 60 minutes, for example, adjustable in some embodiments), the pump module (e.g., 102) that serves the particular zone (e.g., 1001) sends an alarm, for example, to the building automation system (e.g., 109), for instance, that the particular zone (e.g., 1001, for example, a room) is out of humidity control and should be checked (e.g., for an open door).

As mentioned, in a number of embodiments, each zone (e.g., zones 1001 to 1005), is fitted with a zone control valve (e.g., one of valves 1021 to 1025), for example, which controls the flow of hot or chilled water (e.g., 22), for instance, provided by the pump module (e.g., 102), for example, to the chilled beam(s) (e.g., 1011 to 1015) heating and cooling each zone (e.g., 1001 to 1005). Further, in some embodiments, these zone control valves (e.g., in or for each zone) are fitted with an actuator, for example, which is connected to the DDC controller (e.g., 25), for instance, that is integral to the pump module (e.g., serving that zone). Like the zone (e.g., smart) sensors (e.g., thermostats 1031 to 1035), this connection can be a wired connection or can be accomplished wirelessly, in different embodiments. In various embodiments, the (e.g., primary) function of the humidistat (e.g., included in thermostats 1031 to 1035) in (e.g., each) zone (e.g., zones 1001 to 1005) is to allow for the calculation (e.g., by the DDC controller, for instance, serving that zone) of the space dewpoint (e.g., at any point in time), for instance, in that zone, for example, to allow this information to be utilized (e.g., by the DDC controller, for instance, serving that zone), for example, to control the temperature of the chilled water (e.g., 22) distributed to the chilled beam(s) (e.g., 1011 to 1015), for example, located within that zone when in the cooling mode to (e.g., actively) monitor and avoid condensation on the chilled beam(s) (e.g., the coil surface within the chilled beam(s), associated piping, or both).

In some embodiments, the use of dewpoint information (e.g., provided by, or calculated from, the combined temperature and humidity sensor (e.g., thermostat 1031 to 1035) output, for example, in each zone) can be altered, for instance, based upon the size and needs of the specific application. For example, in particular embodiments, if a certain (e.g., chilled-beam) pump module (e.g., 102) is being used to serve a stack of hotel rooms (e.g., five floors), each hotel room (e.g., in the stack) can be a zone (e.g., 1001 to 1005), and in certain embodiments, each zone can have a (e.g., smart) sensor (e.g., thermostats 1031 to 1035), for example, designed or selected to provide both the temperature and humidity, for instance, so that the dewpoint of each room is known (e.g., by DDC controller 25), for instance, at any point in time. In particular embodiments, this can be important, for example, since hotel rooms (e.g., in the same stack) may have widely different humidity levels (e.g., latent loads), for instance, due to the bathrooms (e.g., shower use), a varying number of people in each room, or a combination thereof, as examples. In a number of embodiments, for example, the DDC controller (e.g., 25), for example, in the (e.g., chilled-beam) pump module (e.g., 102) will (e.g., in this example), check the dewpoint of each room (e.g., in the stack, for example, or that is serviced by the pump module, DDC controller, or both), for instance, to determine which zone (e.g., room) has the highest dewpoint, for example, at that particular point in time. The DDC controller (e.g., 25), for instance, may then limit the temperature of the chilled water (e.g., 22) supplied to that zone (e.g., and therefore all zones, for instance, in the stack) to avoid condensation (e.g., on chilled beams 1011 to 1015). In various embodiments, the control system (e.g., DDC controller 25, for example, in pump module 102) cannot rely on the measured or calculated dewpoint of only one zone (e.g., room) to make a chilled water temperature determination for avoiding condensation in all rooms.

In certain embodiments, the spaces (e.g., 101, for example, offices, for instance, zones 1001 to 1005) tend to be dominated by sensible load, for example, solar load, (e.g., temperature), for instance, during the cooling season (e.g., summer). In particular embodiments, for example, an individual office might only have one or two people (e.g., at most) to add humidity. In various embodiments, preconditioned outdoor air, for example, delivered to each chilled beam (e.g., 1011 to 1015) serving the zone (e.g., office) is (e.g., often) dry enough (e.g., low enough dewpoint) to handle all of the latent load (e.g., associated with the occupant, or both). As a result, in particular embodiments, only one zone, office, or office area (e.g., of five) is chosen to be representative of the (e.g., five) zones with regard to latent load. In certain embodiments, the chilled water (e.g., 22) temperature lower limit is set, for example, based upon the dewpoint of one representative zone or office, for example, and the (e.g., chilled-beam) pump module (e.g., 102) or DDC controller (e.g., 25) controls the chilled water (e.g., temperature) sent to all spaces or zones (e.g., offices, for example, serviced by that pump module) based upon this information or dewpoint. This approach, when workable, may substantially reduce the cost and the complexity of the control logic and equipment used to condition individual zones or spaces.

Further, in particular embodiments, for example, in certain large open offices, a single humidity sensor can be located in the return air intake, for example, from the overall office area. In certain embodiments, for example, the minimum cooling water temperature sent to the chilled beams (e.g., 1011 to 1015) by all chilled-beam pump modules (e.g., 102) serving the office area can be determined using a single humidity sensor. In particular embodiments, this embodiment can be used, for instance, in applications where the latent loads are uniform, for example, latent loads that are limited to that generated by occupants, that include minimal infiltration and building permeance, or both.

In various embodiments using a multi-zone (e.g., chilled-beam) pump module approach, it is important or (e.g., highly) preferable that the spaces or zones (e.g., 1001 to 1005) served by a single pump module (e.g., 102) have similar sensible load profiles. For example, in a hotel, in a number of embodiments, all of the zones served by a single pump module should be facing the same direction, have a similar design (e.g., windows), or both, for example, so that the solar load (e.g., the dominant sensible load in a number of embodiments) is similar for all zones served by the same pump module (e.g., 102). This results in either all zones (e.g., rooms) being heated by the sun, or (e.g., at other times of day or year or under different weather conditions) none of the zones being heated by the sun. In various embodiments, the variable loads are modest, for example, loads associated with occupant density, televisions, computers, etc. Likewise, in embodiments in which the zones (e.g., 1001 to 1005) are offices, as other examples, the offices should be facing the same direction, in a number of embodiments, have similar construction and utility, or a combination thereof, as examples.

Control of a multiple-zone chilled-beam pump module (e.g., 102), for instance, in a hotel application, may include, in a number of embodiments, servicing a stack of rooms (i.e., zones) using a single (e.g., chilled-beam) pump module (CBPM), for instance, installed in the ceiling of the bathroom of the ground floor unit. In various embodiments, satisfying the temperature request (e.g., thermostat set point) in each room served by the CBPM monitor or controller (e.g., DDC controller, for instance, 25) involves communication, in a number of embodiments, with the (e.g., smart) thermostats (e.g., thermostats 1031 to 1035) located in each of the hotel rooms (e.g., zones 1001 to 1005). In various embodiments, the thermostats in the rooms provide status of the room temperature, relative humidity, or both, compare the actual room temperature against the requested space set point, or a combination thereof. In some embodiments, for example, if the space set point is not satisfied, the DDC controller (e.g., contained within each CBPM) will send a signal to open the water control valve or zone control valve (e.g., 1021 to 1025) to the chilled beam(s) (e.g., 1011 to 1015), for example, serving the hotel room. In particular embodiments, each chilled beam (e.g., within a zone) is fitted with an on/off control valve (e.g., 1021 to 1024) which is opened to provide cooling or heating as needed. Further, in certain embodiments, (e.g., large, apartment-style hotel suites) contain two room thermostats and a humidity sensor. In some such embodiments, for instance, the first thermostat serves the main space for temperature control of the guest room. In particular embodiments, a second sensor is located, for example, in the bedroom, for instance, for the purpose of monitoring temperature, dewpoint (e.g., for condensation control), or both.

Strategic selection of the guest rooms for each CBPM is advisable in a number of embodiments. In various embodiments, for example, the hotel rooms served by a single CBPM are selected so that all rooms are facing the same direction, for instance, so the solar load will be similar for each room. In a number of applications, solar load is (e.g., by far) the dominant cooling load, for example, for hotels designed with a typical window allocation. In particular embodiments, for instance, a stack of (e.g., five) units or rooms are served by a single CBPM. In this way, the cooling load requirements, heating load requirements, or both, for (e.g., all) rooms served by the same CBPM are usually similar. Thus, in a number of embodiments, zones (e.g., 1001 to 1005) or rooms served by a single CBPM (that call for cooling or heating) usually either all call for cooling or all call for heating, with few occasions where some rooms legitimately need cooling while others served by the same CBPM legitimately need heat.

In a number of embodiments, when all zones (e.g., hotel rooms) that are served by one CBPM are either calling for cooling or are not calling for cooling or heating, then the (e.g., variable) speed pump (e.g., 21) in that CBPM operates (e.g., under control of the controller, for instance, 25, in that CBPM), for example, at a predetermined cooling mode water flow rate. In particular embodiments, the water temperature is controlled (e.g., by the CBPM controller, for instance, 25) to be (e.g., at least) a certain temperature differential (e.g., 1-degree F. or C.) above the (e.g., maximum or highest) dewpoint of the most-humid zone (e.g., 1001 to 1005) or room (e.g., in the stack) served by the CBPM. In certain embodiments, this temperature differential is adjustable, for example, at the CBPM controller (e.g., 25). In various embodiments, the colder the water temperature delivered to the chilled beams (e.g., 1011 to 1015) can be, which is controlled by the highest dewpoint measured in the zones (e.g., 1001 to 1005) served by the CBPM, the higher the cooling capacity output from each chilled beam. As a result, in particular embodiments, if the requested cooling mode thermostat settings are not achieved (e.g., not achieved in at least one zone served by the CBPM), and if the highest zone (e.g., hotel room) dewpoint will allow it, the chilled water (e.g., 22) temperature leaving the CBPM is lowered (e.g., incrementally, for instance, by the CBPM controller) until all zone (e.g., room) thermostats (e.g., 1031 to 1035) are satisfied. In certain embodiments, if the zones (e.g., room thermostats) cannot be satisfied with the lowest available supply water (e.g., 22) temperature within a (e.g., preset) period of time (e.g., 15 mins, for instance, which may be adjustable, for example, at the CBPM controller), then the water flow rate to the beams is (e.g., incrementally) increased, for example, until all zones (e.g., room thermostats) are satisfied, for instance, since increased water flow rates will also increase the cooling capacity output (e.g., by evening out the temperature of the chilled beams in the zone(s) that call for cooling at a lower average temperature).

In some embodiments, if any zones (e.g., 1001 to 1005) or rooms served by a CBPM are calling for heat (e.g., during the heating season), or if all zones or rooms are satisfied for cooling during the cooling season and (e.g., one) zone or room is in need of heating, a similar control sequence to that described above is used except hot water is supplied to the chilled-beam loop (e.g., between the pump module and the chilled beams in the zones served by that pump module). One major difference is that there is no concern for condensation control when heating. In certain embodiments, part load cases may be addressed where legitimate cooling and heating are needed in different zones (e.g., rooms) served by the same CBPM at the same time. If some zones (e.g., some of 1001 to 1005) or rooms are calling for cooling and others are calling for heating, the CBPM, in particular embodiments, will look to the seasonal mode, in some embodiments, (either cooling or heating) to see which has priority. In a number of embodiments, the CBPM (e.g., DDC controller 25) will operate to satisfy those rooms first, for example, according to a scheme described herein. In various embodiments, during the cooling mode (e.g., in almost all cases), the absence of chilled water flow to the chilled beam (e.g., 1011 to 1015) is the first stage of heat as the space will heat up due to the internal loads. On sunny days, solar loads may be significant, so simply removing cooling, in some embodiments, may satisfy (e.g., most) legitimate heating requests during the cooling season. In a number of embodiments, when cooling has priority, zone control valves (e.g., 1021 to 1025) serving the zones or rooms calling for heating are closed and zone control valves serving the zones or rooms calling for cooling are open, for example, until all zones or rooms calling for cooling are conditioned, for instance, to the requested (e.g., allowable) set point temperature.

In some embodiments, if, or when, a zone (e.g., 1001 to 1005) or room calls for heating when (e.g., the pump module serving that zone is) in the cooling mode, and if all other zones or rooms served by that pump module (e.g., 102) that are set for cooling are at set point, then, in particular embodiments, the (e.g., chilled-beam) pump module will close the chilled-beam control valves or zone control valves (e.g., 1021 to 1025) to all satisfied zones or rooms. In certain embodiments, the pump module (e.g., 102) then switches over from cooling to heating, for example, following a delay suitable to allow chilled water (e.g., 22) to leave the distribution piping (i.e., between the pump module and the chilled beams, for instance, 107). In particular embodiments, the zone control valve serving the zone or room (or zones or rooms) requesting heating is (are) opened to provide heating as requested. In certain embodiments, the pump module switches over from cooling to heating, for example, only if, or when, a legitimate set point request has been entered (e.g., within a certain range of temperature), the set point is at least a certain threshold (e.g., 2 degrees) warmer than the actual room temperature, or both. In some embodiments, for example, the certain range of temperature, the certain threshold, or both, are adjustable, for instance, at the (e.g., chilled-beam) pump module (e.g., controller 25). In various embodiments, the heating is then delivered to the zone, zones, room, or rooms in need of heat, for example, for a minimum run time (e.g., 10 minutes, for example, adjustable in some embodiments, for instance, at the pump module) until the space temperature set point is reached, or in particular embodiments, until the space temperature is within a particular temperature differential (e.g., 1 degree) of the requested heating set point, for instance, if all cooling requests are not (e.g., are no longer) satisfied within the other zones (e.g., served by that same pump module).

In some embodiments, when a (e.g., chilled-beam) pump module (e.g., 102) is operating with requests (e.g., from the zone thermostats, for instance, 1031 to 1035) for both heating and cooling in different zones (e.g., 1001 to 1005) or rooms (i.e., served by that pump module) at the same time, the module pump (e.g., 21) water flow is defaulted to the maximum (e.g., for the mode selected), for example, so that the requested heating and/or cooling set points are satisfied as quickly as possible. Further, in some embodiments, when operating in the heating priority mode and a cooling request occurs simultaneous with heating requests, a similar methodology is used. In particular embodiments, for example, if the absence of heating does not provide adequate cooling, the pump module (e.g., 102) will switch over to provide cooling as needed for a (e.g., legitimate, for instance, within a particular range of temperature, which may be adjustable in some embodiments) cooling request. When operable windows are allowed, in some embodiments, an additional level of control complexity may be included, for example, to take into account the effect of operable windows opened, for instance, during inappropriate times. In certain embodiments, for example, windows being open during inappropriate times are considered to result in illegitimate heating or cooling requests (or both). In some embodiments, for example, illegitimate heating or cooling requests are not responded to, for instance, by the pump module.

In various embodiments, the determinant for the operational mode of a (e.g., chilled-beam) pump module (e.g., 102) is set by priority mode (e.g., heating or cooling priority) which, in some embodiments, is a function of the heating balance point of the building (e.g., when losses through the building envelop will cause most zones or rooms to need heating or most zones or rooms to need cooling). In particular embodiments, for example, the operational mode of a chilled-beam pump module is based upon the outdoor air temperature (e.g., measured at outdoor air temperature sensor 108), by the number of heating and cooling requests made by the (e.g., zone) thermostats (e.g., 1031 to 1035, e.g., of the system (e.g., 100) or of zones served by the chilled-beam pump module, for instance, in each individual stack), or both. In certain embodiments, for example, when the outdoor air temperature is below a (e.g., predetermined) balance point condition, the BAS (e.g., 109), for example, provides a global command (e.g., to all pump modules in the system, for instance, 100) to be in heating priority. Further, in various embodiments, when not in heating priority, the building is in cooling priority. In some embodiments, the cooling priority mode prioritizes the spaces (e.g., of zones 1001 to 1005) requesting cooling (e.g., first) before switching over to heat any (e.g., outlier) zone (e.g., room) that is requesting heating. In a number of embodiments, when in heating priority mode, the opposite occurs.

It is not uncommon for the west side of a building to need heating while the east side of a building needs cooling, for example. As a result, in some embodiments, the (e.g., chilled-beam) pump modules (e.g., 102, for instance, representing zones that the pump modules serve, for instance, individual stacks of rooms) determine when to be in cooling dominant vs heating dominant modes, for example, rather than a global control decision. In certain embodiments, for instance, heating and cooling requests made by the thermostats (e.g., 1031 to 1035) in each zone (e.g., each room in a stack of rooms) are fed to the pump modules (e.g., DDC controllers, for instance, 25). In some embodiments, for example, by tracking the percentage of heating requests made and the time element associated with these requests, a determination can be made (e.g., by the pump modules or DDC controllers) regarding heating or cooling priority. For example, in some embodiments, if three out of the five zones (e.g., 1001 to 1005) call for heating (e.g., without calling for cooling) over a preceding period of time (e.g., 2 hours), then the pump module (e.g., stack) converts to the heating dominant mode, for instance, until the majority of the zones (e.g., rooms) call for cooling (e.g., without a heating request), for instance, for the (e.g., same) preceding period of time (e.g., 2 hours).

In some embodiments, for example, hotel rooms, when a zone (e.g., 1001 to 1005) is unoccupied (e.g., based upon input from the BAS, for instance, 109, or from a room sensor) the set point is (e.g., automatically) designated, for example, based upon the priority mode, for instance, as described above. In particular embodiments, for example, the strategy is to maintain a comfort level (e.g., that will satisfy over 90 percent of the guests) when entering the zone (e.g., room). Further, in some embodiments, set points are based upon continuous cooling season humidity control and guidelines recommended by ASHRAE research reported by Burgland and the Georgia Tech Research Institute (see referenced ASHRAE article). In various embodiments, numerous advantages are offered (e.g., to the building occupants, the owner, or both), for example, by using this methodology. In particular embodiments, for instance, a suggested cooling season unoccupied set point is 76 degrees. Still further, in certain embodiments, the heating season unoccupied set point is 68 degrees. In various embodiments, however, such set points are adjustable (e.g., at the BAS, at the control module, or both). In a number of embodiments, for example, building occupants encounter these conditions upon entering an unoccupied zone (e.g., room). Once the zone or room is occupied, the guest is allowed to adjust the space temperature set point, in various embodiments, if desired. In certain embodiments, for instance, the zone thermostats (e.g., room smart thermostats, for instance, 1031 to 1035) allow a (e.g., wide) range of requested temperatures by the occupant (e.g., guest). But in some embodiments, the logic will lock boundaries of the allowable occupied room temperature set point requests, for example, based upon the mode selected (e.g., heating or cooling mode or season).

In particular embodiments, (e.g., based upon ASHRAE research) a suggested range for the cooling mode is 73 to 77 degrees F. and the suggested range for the heating mode is 70 to 74 degrees F. In some embodiments, the ranges can be adjusted (e.g., up or down) but, in certain embodiments, the range between the highest heating set point and the lowest cooling set point (e.g., in a stack of zones (e.g., 1001 to 1005) or rooms served by one pump module) should be limited, for example, to avoid an unreasonably high or low set point requested by one zone or room (e.g., in a stack) restricting the ability of other zones or rooms from reaching their requested set point temperature.

In various embodiments, when serving multiple zones (e.g., 1001 to 1005) with one pump module (e.g., 102), one of the challenges is to ensure that the module pump (e.g., 21) has return water flow, when in operation, for example, when all zone temperatures are satisfied, and all zone control valves (e.g., 1021 to 1025) are therefore closed. One way to solve this problem is to install at least one diverting valve, for instance, a three-way zone control valve (e.g., 1025) installed in place of a two-way zone control valve (e.g., 1021 to 1024). In various embodiments, water (e.g., 22) is returned to the module pump (e.g., 21), for example, even when all zone temperatures are satisfied. In some embodiments, however, energy is saved by not running the module pump during (e.g., extended) periods when all zones (e.g., 1001 to 1005) served by that pump module (e.g., 102) are satisfied. Further, in embodiments that include a diverting valve (e.g., 1025), if the diverting valve is mis-wired or fails, the module pump may continue to pump with nowhere for the water to go (i.e. dead head). Also, the added piping required by a diverting valve may not be easily accommodated, for example, in tight spaces allocated in ceiling plenums where the chilled beams (e.g., 1011 to 1015) are installed. In some embodiments, (e.g., instead of including a diverting valve), the pump module (e.g., DDC controller 25) monitors the valve signal to, or position of, the (e.g., two-way) zone control valves serving each zone (i.e., served by that pump module). When, for example, all (e.g., five) zones served by that pump module are satisfied, the zone control valves are (e.g., commanded) closed, or both, for instance, the module pump (e.g., 21) is commanded to stop. While this control feedback provides a solution to effective pump operation in a number of embodiments, it is not necessarily fail safe, so in particular embodiments, a secondary level of monitoring is employed. For example, in particular embodiments, if one zone control valve fails or is wired incorrectly, even though the DDC controls of the pump module thinks that the zone control valve is open allowing the space (e.g., within the zone, for instance, 1001 to 1005) to be conditioned, it actually could be closed. When all other zone control valves are closed, the module pump (e.g., 21) would be forced to operate against a closed system and dead-head, without a secondary check. In certain embodiments, a (e.g., secondary) check is accomplished, for instance, by monitoring temperature, for example, the water (e.g., 22) temperature leaving the module pump (e.g., 21) or leaving the pump module (e.g., 102). In particular embodiments, if a single zone control valve is showing an open status, but the water temperature leaving the module pump, for example, is hotter than either the heating or cooling set point, the module pump is reported to be dead-heading. In addition, if the space (e.g., zone) where the zone control valve is shown to be opened is not being conditioned, despite the call for the zone control valve to be open, then an alarm reporting a zone control valve failure is sent to the BAS (e.g., 109).

Another common problem, in particular embodiments, is cross connecting the zone control valve (e.g., 1021 to 1025) of one zone (e.g., one of zones 1001 to 1005) with another. This may result, for example, in one zone served by the pump module (e.g., 102) being over-heated, while another remains cold, receiving no heating. In this example, an (e.g., adjacent) zone calling for heating does not get heat because the wrong zone control valve is opening. The overheated room closes the zone control valve serving the wrong room, for instance, so this room remains cold, calling for heat that is not delivered, while overheating the adjacent room. Since the DDC controller (e.g., 25) of a (e.g., chilled-beam) pump module, in a number of embodiments, monitors both the zone temperatures and zone control valve positions in multiple zones (e.g., 1001 to 1005), it can be operated such that when a zone or room that calls for heating (or cooling) but is not responding, at the same time that a zone or room that is not requesting heating (or cooling) continues to overheat, an alarm suggesting cross-wiring and identifying the zones in question is sent, for instance, to the BAS (e.g., 109).

Various embodiments include control enhancements, for example, to support initial commissioning, promote long term operation, or both, for instance, for the owner or end user. FIGS. 3-8 illustrate examples. In a number of embodiments, various features are directed to troubleshooting, commissioning, monitoring proper system operation, or a combination thereof, as examples. In various embodiments, the added complexity of a multi-zone chilled-beam system (e.g., substantially) increases the effort required to install, commission, and monitor proper operation of the system. Therefore, some embodiments integrate enhanced capabilities to support the installation, commissioning, operational process, or a combination thereof, for instance, of a multi-zone chilled-beam system (e.g., 100). In a number of embodiments, for example, the DDC controller (e.g., 25) in the (e.g., chilled-beam) pump module (e.g., 102) provides (e.g., to the BAS, for instance, 109) monitoring alarms, for instance, to confirm that the system (e.g., 100) is being operated efficiently and properly.

Some embodiments, for example, include dewpoint monitoring. For instance, in particular embodiments, if a space (e.g., zone, for instance, 101 to 1005) dewpoint (e.g., measured at, or calculated from data measured at, one or more of thermostats 1031 to 1035) exceeds 60 degrees, for example, which is adjustable in some embodiments, the system (e.g., at the pump module, for instance, 102) closes the zone control valve (e.g., 1021 to 1025) to the chilled beam(s) (e.g., 1011 to 1015), for example, serving this zone (e.g., 1001 to 1005, e.g., room), ignores this zone from limiting the chilled water (e.g., 22) supply temperature to the remaining zones served by the same chilled-beam pump module (e.g., 102), or both, for instance, until the dewpoint in that zone drops to an acceptable range. This may occur, for example, in a hotel during an extremely long shower by the occupant. Further, in some embodiments, if a room exceeds a certain (e.g., 60 degree F.) dewpoint, for instance, for more than 20 mins (e.g., adjustable in some embodiments) it may signify that a door or an operable window was left open or that the primary airflow delivered to the zone is either insufficient or is not being properly dehumidified. In such an event, in some embodiments, the zone control valve serving the zone is closed (e.g., by the pump module) so that no cooling is provided until the space (e.g., zone) is back under humidity control (e.g., window closed or primary air problem is resolved). In various embodiments, if unusually high humidity occurs over an extended period and is isolated to one zone, for example, an alarm is sent (e.g., to the BAS, for instance, 109) to alert that a room is out of humidity control and should be checked. In particular embodiments, if the high humidity is reported in multiple zones (e.g., 1001 to 1005), in multiple pump modules (e.g., 102 and 103), or both, then an alarm is sent (e.g., to the BAS) to alert, for example, that the dehumidification provided by the primary airflow is not working properly, is not accomplishing desired objectives, should be checked, or a combination thereof. For example, such an alarm may indicate that primary airflow may be off or insufficient or that dewpoint of the primary airflow may not be low enough to address current latent loads, as examples.

Certain embodiments include space temperature monitoring. For example, in some embodiments, an alarm is provided if any zone (e.g., room, for instance, 1001 to 1005) cannot be maintained at a viable space temperature set point (e.g., input into the thermostat within the zone, for example, thermostats 1031 to 1035), for instance, after more than a predetermined period of time following the request. An example of such a predetermined period of time is 30 minutes, for instance, which may be adjustable in a number of embodiments (e.g., at the pump module, for instance, 102). Further, in some embodiments, if none of the zones (e.g., 1001 to 1005) served by a chilled-beam pump module (e.g., 102, for instance, rooms on a stack) are cooling when cooling is requested (e.g., by thermostat setting and set point, for example, at thermostats 1031 to 1035) and the reported water (e.g., 22) temperature is not cool (e.g., between module pump 21 and the chilled beam(s)), an alarm is sent, for example, to check for pump (e.g., 21) failure, zone control valve (e.g., 1021 to 1025) failure, or to bleed air to resolve air lock, as examples. Still further, in some embodiments, if some zones (e.g., rooms, for instance, zones 1001 to 1005) are cooling while others are not, and the water (e.g., 22) temperature (e.g., leaving module pump 21) is cool, an alarm is sent, for example, to check wiring, actuators, or both, for example, serving the chilled beams (e.g., 1011 to 1015) in the zone or zones that are not cooling. Even further, in some embodiments, if none of the zones (e.g., 1001 to 1005, for instance, rooms on a stack) served by a chilled-beam pump module (e.g., 102 are heating when heating is requested (e.g., by thermostat setting and set point, for example, at thermostats 1031 to 1035), and the water (e.g., 22) temperature is not hot (e.g., leaving the module pump, for instance, 21), an alarm is sent, for instance, to check for module pump failure or zone control valve (e.g., 1021 to 1025) failure, as examples. "Even further still, in some embodiments, if some rooms (e.g., zones 1001 to 1005) are heating while others are not, and if the water temperature is hot, an alarm is sent, for example, to check wiring, actuators, or both, for instance, serving the chilled beams (e.g., 1011 to 1015) in the zones that are not heating. Moreover, in some embodiments, if a call is being made (i.e., by a thermostat, for instance, one of 1031 to 1035) for heating, but chilled water (e.g., 22) is being provided in lieu of hot water, for example, then an alarm is sent, for instance, to check the dip switch settings on the hot and chilled water control valves, or modulating valves (e.g., 24 and 26), for example, that determine whether hot or chilled water is delivered to the pump module (e.g., 102). Various alarms described herein are sent from the pump module (e.g., 102), to the BAS (e.g., 109), or both, as examples.

Further, in certain embodiments, an alarm is provided (e.g., to the BAS, for instance, 109) if the calculated water temperature set point (e.g., determined by algorithms in the DDC controller, for instance, 25, of the pump module, for example, 102) delivered from the module pump (e.g., 21) to the chilled beams (e.g., 1011 to 1015) cannot be maintained. This may occur, for example, when the chilled or hot water temperatures are not as required. Still further, in some embodiments, if the control system (e.g., of the pump module, for instance, 102) calls for hot water and the hot water control valve (e.g., 26) is commanded open, but the water (e.g., 22) temperature (e.g., leaving the module pump, for example, 21) is cold, then alarm is sent, for example, to check dip switches on the hot and chilled water control valves (e.g., 24 and 26). Even further, in some embodiments, if the control system (e.g., controller 25) calls for chilled water (e.g., 22) and the chilled water control valve (e.g., 24) is commanded open, but the water (e.g., 22) temperature is hot, then an alarm is sent, for instance, to check dip switches on the hot and chilled water control valves (e.g., 24 and 26), bleed the system to ensure it is not airlocked, or both. Still further, in particular embodiments, if the control system (e.g., 25) calls for either chilled or hot water, and the water (e.g., 22) temperature is hotter than the maximum limit on the hot water output algorithm, then an alarm is sent, for example, signaling that the module pump (e.g., 21) may be airlocked or pumping against closed valves (e.g., zone control valves, for example in embodiments where all zone control valves are 2-way valves, for instance, like valves 1021 to 1024 shown).

Figure 3:
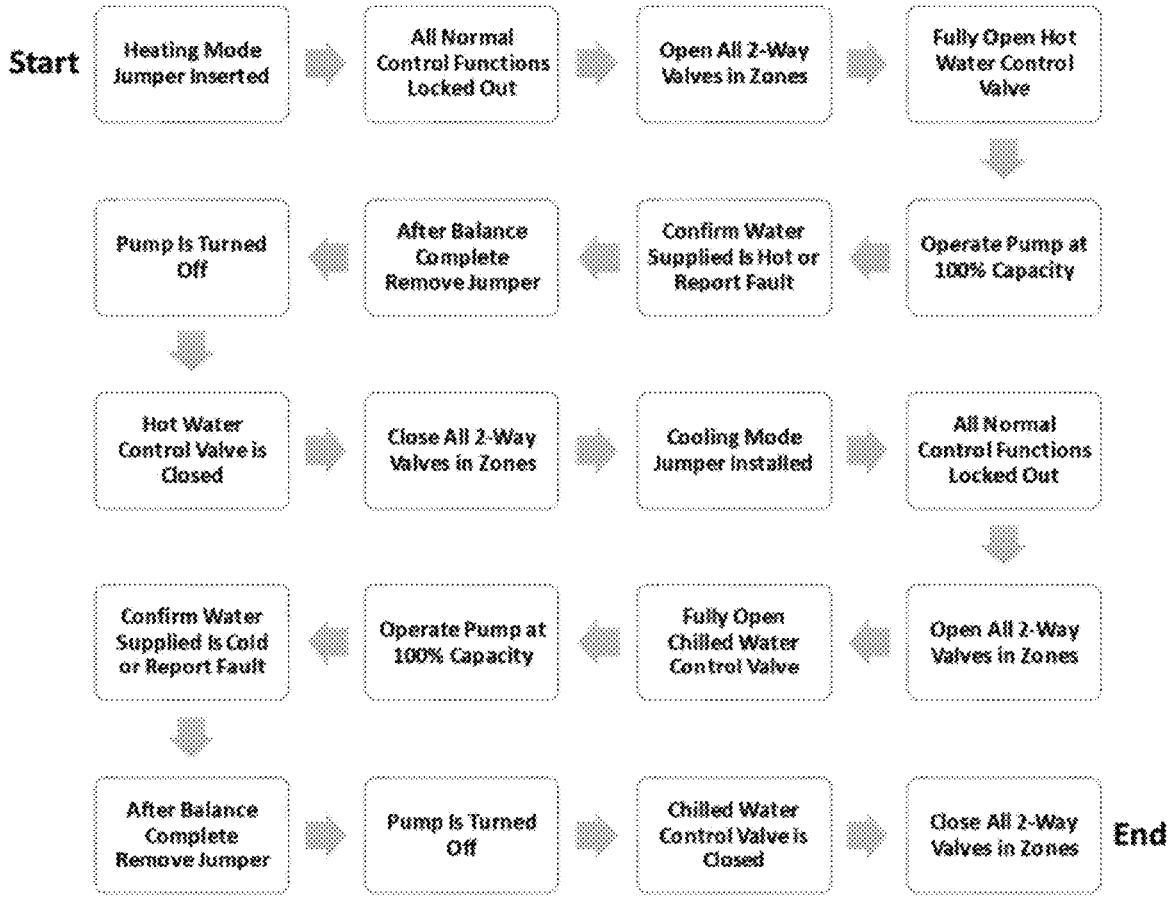
FIG. 3 is a flow chart illustrating an example of a method of testing a multiple-zone air conditioning system, for instance, on initial startup.
Figure 4:
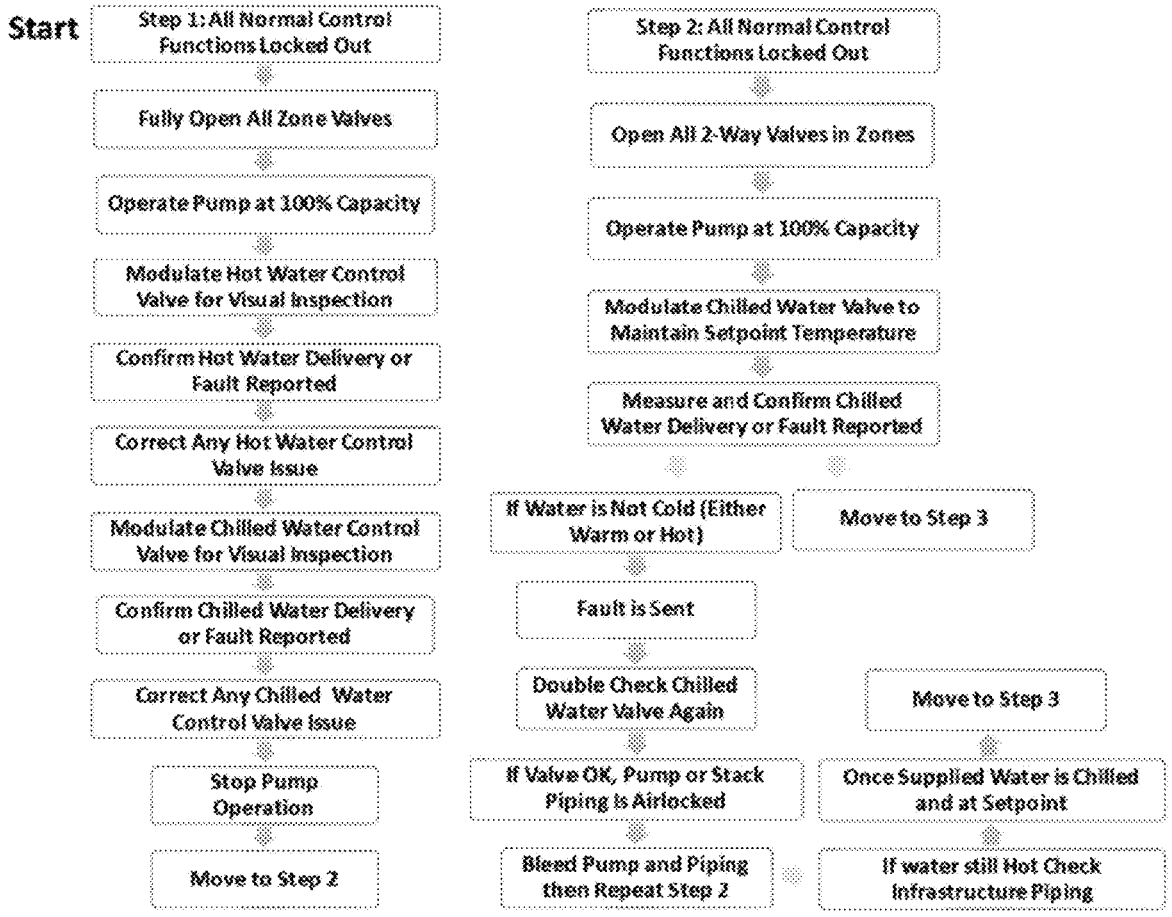
FIGS. 4 to 7 are flow charts illustrating examples of methods of testing and troubleshooting a multiple-zone air conditioning system, for instance, on initial startup or in a startup and troubleshooting mode.
Figure 5:
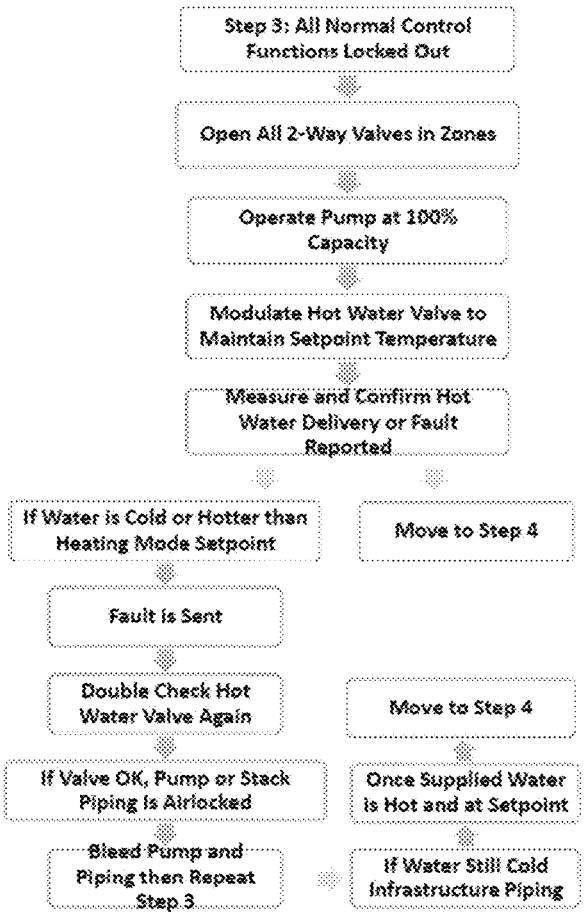
Figure 6:
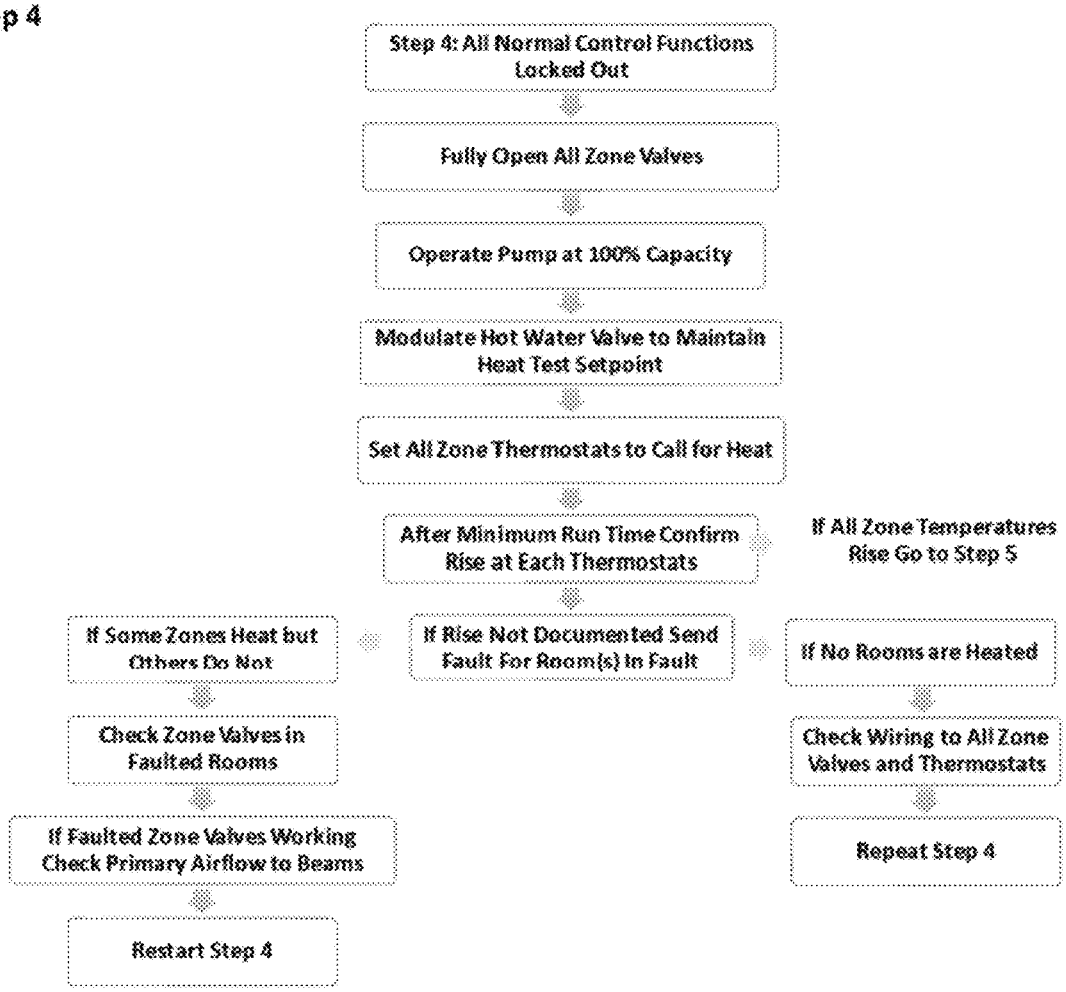
Figure 7:
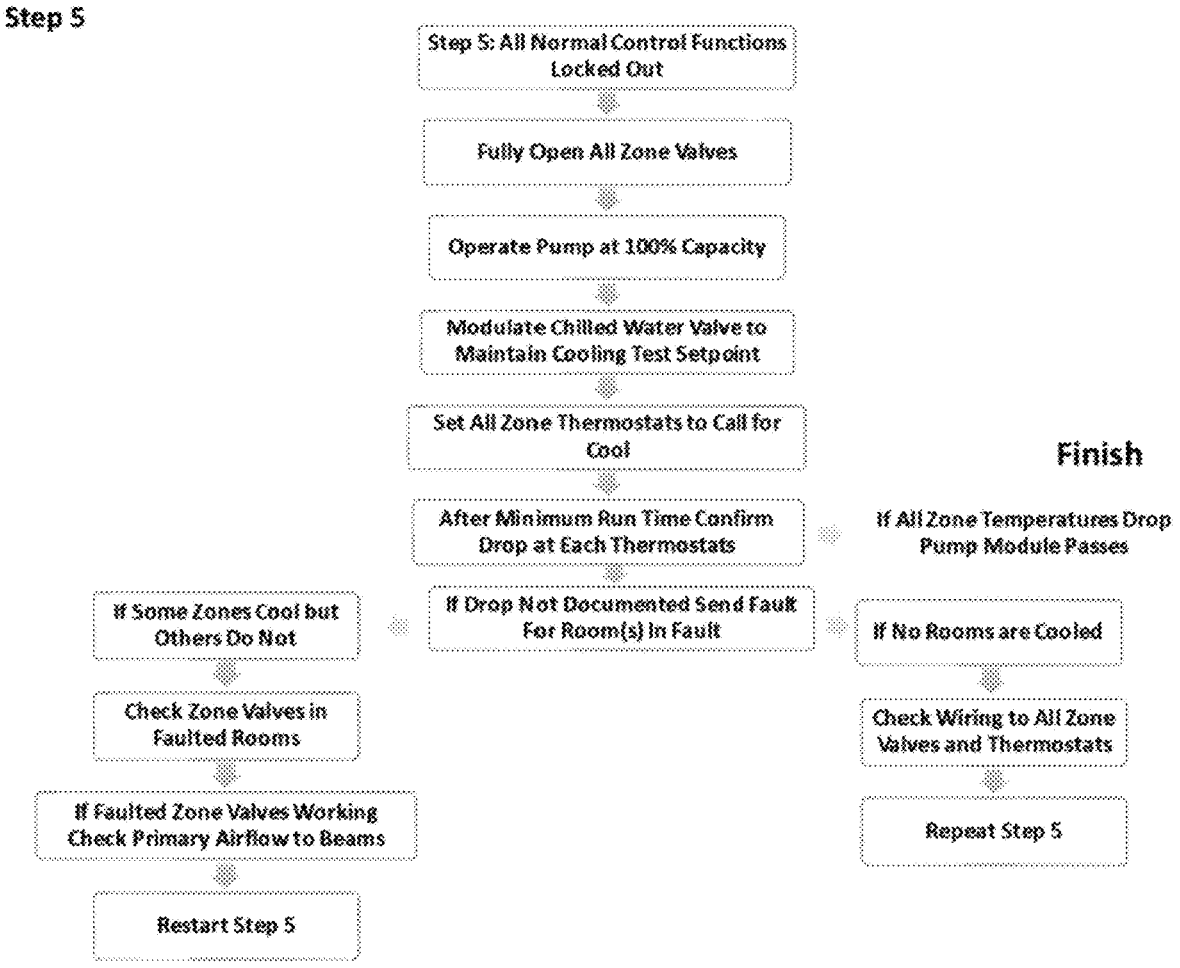

Various embodiments include a pre start-up balancing mode. FIG. 3, for example, illustrates an example of a method of testing a multiple-zone air conditioning system (e.g., 100), for instance, on initial startup. Often, the first installation checks following the initial installation of the (e.g., chilled-beam) pump modules (e.g., 102), is a balancing step, for example, to ensure that the appropriate water flow (e.g., 22) is being delivered to chilled beams (e.g., 1011 to 1015) in the individual zones (e.g., 1001 to 1005), for instance, without leaks or unexpected flow restrictions in the water distribution piping (e.g., 107). In some embodiments, for example, it is not uncommon for some of the distribution piping to be changed, for instance, due to space limitations or obstructions, for example, or for the wrong size or type of fittings to be used. Other issues as well, or instead, may add pressure loss to the distribution system. The best time to deal with these issues may be during the installation process rather than after the building (e.g., space 101) begins the final commissioning mode, for example.

In some embodiments, (e.g., to facilitate startup), a MANUAL initial balance/test mode is integrated, for example, into each pump module (e.g., 102). In various embodiments, such a mode is driven by jumpers, as opposed to requiring the connection of a computer or other device, which would involve either the controls contractor or factory service technician who may not be onsite during this test mode. In certain embodiments, for example, a pre-startup balance mode can be initiated. Further, in various embodiments, there is a chilled water balancing mode, a hot water balancing mode, or both. Still further, in some embodiments, a mode (e.g., each mode) is initiated by adding a temporary manual jumper (e.g., different for each mode) allowing the test mode to run, for instance, for as long as desired. For example, in some embodiments, a chilled water (CW) balance mode is initiated by placing a jumper wire on the appropriate input and once the jumper has been in place for several seconds, the corresponding balancing mode is initiated. In certain embodiments, for example, first, all 2-way zone control valves (e.g., 1021 to 1024) are opened, and the appropriate pump module modulating control valve (e.g., CW 24 or HW 26) is commanded open 100%. Even further, in particular embodiments (e.g., after a second time delay, for instance, to allow all the zone control valves to reach 100% open), the module pump (e.g., 21) is run at 100 percent speed. In some embodiments, for example, the pump module (e.g., 102) operates in this mode as long as is needed to check and balance the multi-zone pipe distribution system (e.g., 107). Even further, in a number of embodiments, when the jumper is removed, the module pump (e.g., 21) is shut off (e.g., immediately) and the appropriate modulating valve (e.g., CW 24 or HW 26) is commanded closed (e.g., after a short delay). Even further still, in some embodiments (e.g., after another time delay), all of the 2-way zone control valves (e.g., 1021 to 1024) are de-energized and closed. In some embodiments, for example, during balance modes, the other pump module control functions (e.g., set point modulation of valves) are forced into a shutdown state, for instance, until after the balancing mode is fully exited. Moreover, in some embodiments, a hot water (HW) balance mode is the same as just described but using a second jumper location.

Figure 8:
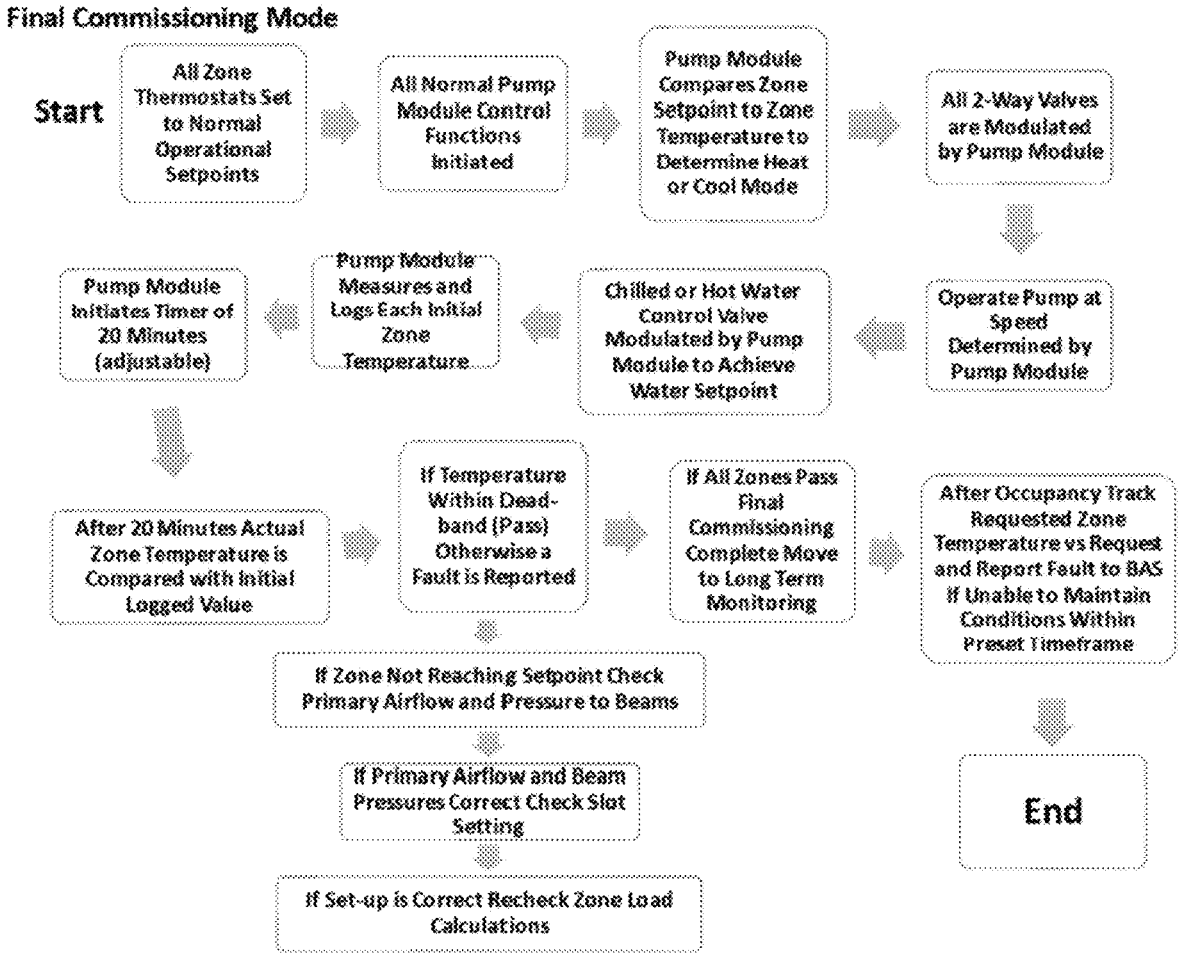
FIG. 8 is a flow chart illustrating an example of a method of testing a multiple-zone air conditioning system, for instance, in a final commissioning mode.

In a number of embodiments, features are provided for initial start-up and troubleshooting during installation. FIGS. 4 to 7 illustrate examples of methods of testing and troubleshooting a multiple-zone air conditioning system (e.g., 100), for instance, on initial startup or in a startup and troubleshooting mode. Further, FIG. 8 illustrates an example of a method of testing a multiple-zone air conditioning system (e.g., 100), for instance, in a final commissioning mode. In various embodiments, for example, the added complexity of controlling multiple zones (e.g., 1001 to 1005) with one pump module (e.g., 102) creates troubleshooting challenges for the installing contractor, especially when they are not familiar with the new technology. In a number of embodiments, an integral troubleshooting mode simplifies the installation process, minimizes system-wide problems, or both. Some of the more common problems encountered and resolved by the troubleshoot mode include, for example, improper installation of hot and chilled water infrastructure (e.g., chilled water hooked to the hot water inlet, for instance, 261, and hot water hooked to the chilled water inlet, for example, 241). Another example is having the wrong dip switch settings on the hot and chilled water valves, for instance, causing them to operate in reverse. Another example is having the incorrect wiring connections, for example, between the zone control valves (e.g., 1021 to 1025) and the pump module DDC controller (e.g., 25). Still another example is having air in the piping system, for instance, causing the module pump (e.g., 21), for example, to be airlocked. This can be especially problematic since when the pump continues to run, yet water does not flow due to air in the system, the water near the pump heats up to a high temperature which can be confused for hot water flowing through the system and must therefore be properly identified. Yet other examples of problems include having low primary airflow to the chilled beams (e.g., 1011 to 1015), and having the wrong slot setting for a given chilled beam serving a zone (e.g., 1001 to 1005).

In certain embodiments, a troubleshooting mode is included (e.g., within the code of the DDC control panel) that can, for instance, identify anticipated installation and operational problems of a multi-zone chilled-beam installation, for instance, by applying the following methodology. Some embodiments include, for example, (e.g., in a Step 1), on command, a (e.g., phase 1) commissioning mode first runs the module pump (e.g., 21), for instance, for 2 minutes, for example, to allow visual confirmation of operation. Certain embodiments then cycle the hot water valve (e.g., 26, for instance, a modulating valve, wide open then closed followed by the chilled water (e.g., 24) modulating valve being cycled from wide open to closed, for example. Should these valves (e.g., modulating valves) operate in an altered sequence from that outlined in the start-up manual, then the dip switches should be checked. Further some embodiments include (e.g., in a Step 2), for instance, on command of the (e.g., phase 2) commissioning mode, all of the zone control valves (e.g., 1021 to 1025) are powered open, then the system is operated in the cooling mode (e.g., for 10 minutes). In some embodiments, the hot water valve (e.g., 26) remains closed, and the chilled water valve (e.g., 24) is modulated open, for example, to maintain a preset chilled water (e.g., 22) temperature (e.g., of approximately 58 degrees). During operation, in a number of embodiments, the temperature of the chilled water (e.g., 22) is monitored, for example, by the onboard water temperature sensor (e.g., 23, for instance, in pump module 102). In various embodiments, if the water (e.g., 22) temperature is not achieved and/or the water is hot, and the valves (e.g., 1021 to 1025)

are working properly (e.g., as per Step 1), then the pump (e.g., 21) may be airlocked and a fault is shown in some embodiments. In this case, the system (e.g., 100) may need to be bled of air, for example, until chilled water (e.g., 22) is observed. Further, in some embodiments, if air is bled from the pipe system and the hot water continues in the cooling mode, then the infrastructure connection (e.g., at 241, 242, 261, and 262) of the chilled and hot water (e.g., systems 104 and 106) may need to be re-checked.

In some embodiments, (e.g., in a Step 3), for instance, on command of the (e.g., phase 3) commissioning mode, all of the zone control valves (e.g., 1021 to 1025) are powered open, and then the system is operated in the heating mode (e.g., for 10 minutes). In various embodiments, the hot water valve (e.g., 26) opens and the chilled water valve (e.g., 24) remains closed, or both. In a number of embodiments, for example, during operation, the temperature of the water (e.g., 22) delivered to the chilled beams (e.g., 1011 to 1015) is monitored (e.g., by onboard water temperature sensor 23). In various embodiments, if the target water temperature is not achieved (e.g., after the preset time limit), and the water (e.g., 22) is hotter than that requested by the control algorithm, and the valves are working properly (e.g., as per Step 1), a fault is shown. In this case, the module pump (e.g., 21) may be airlocked and the system (e.g., 100) may need to be bled of air, for example, until the requested hot water temperature is observed. Further, in a number of embodiments, if chilled water (e.g., 22) is measured when hot water is requested, then the infrastructure connection (e.g., at 241, 242, 261, and 262) of the chilled and hot water (e.g., systems 104 and 106) may need to be checked.

Further, in some embodiments, (e.g., in a Step 4), on command of the (e.g., phase 4) commissioning mode, all of the zone control valves (e.g., 1021 to 1025) are powered open, then the system is operated in the heating mode (e.g., for 20 minutes). The hot water valve (e.g., 26) opens and the chilled water valve (e.g., 24) remains closed. During operation, the temperature of the water (e.g., 22) delivered to the chilled beams (e.g., 1011 to 1015) is monitored (e.g., by onboard water temperature sensor 23) and all space (e.g., zone) temperature set point temperatures are temporarily set to 90 degrees. In some embodiments, the control logic (e.g., in pump module 102) tracks each zone (e.g., 1001 to 1005) temperature when (e.g., phase 4) commissioning starts and notes the zone temperature at the start of the test and again (e.g., 20 minutes) later when the cycle ends. In various embodiments, if the temperature of the space (e.g., zone) rises as anticipated, the step passes. Otherwise, in a number of embodiments, a fault is shown. These faults may be shown, for example, on a room-by-room (e.g., zone-by-zone) basis. If all but one zone (e.g., of zones 1001 to 1005), for example is heated, then the zone control valve (e.g., of valves 1021 to 1025) serving the zone that did not heat may be checked, for instance, for proper wiring for a and functioning actuator. Still further, in some embodiments, if the zone control valve is operating properly, but little or no heating is being observed, it may be appropriate to check the primary airflow to the chilled beam(s) (e.g., of beams 1011 to 1015) serving the zone, the slot setting of the beam(s), or both. In various embodiments, once remedied, the (e.g., step 4) test can be repeated. If all zones (e.g., rooms) heat as expected, then it may be appropriate to move on (e.g., to step 5).

Still further, in some embodiments, (e.g., in a Step 5), for instance, on command of a phase 5 commissioning mode, all zone control valves (e.g., 1021 to 1025) are powered open, and then the system (e.g., pump module) is operated in the cooling mode, for example, for 20 minutes. In various embodiments, the chilled-water valve (e.g., 24) is modulated open and the hot-water valve (e.g., 26) is (e.g., remains) closed. During operation, in a number of embodiments, the temperature of the water (e.g., 22) delivered to the beams is monitored by the onboard water temperature sensor (e.g., 23) and the space (e.g., zone) set point temperatures are temporarily set to 60 degrees, for example. In various embodiments, the pump module (e.g., 102, for example, controller 25) tracks each zone (e.g., 1001 to 1005) temperature (e.g., of each zone served by that pump module, for instance, 102) during phase 5 commissioning, for example, at the start of the test and again (e.g., 20 minutes later) when the cycle ends. If the temperature of the space (e.g., zones) drops as anticipated, the step passes. Otherwise, it fails, and a fault is shown for the zone/zones (e.g., 1001 to 1005) not cooling (e.g., zone(s) served by that pump module, for instance, 102). If all but one zone, for example, is cooled, then the zone control valve (e.g., one of valves 1021 to 1025) serving the zone that did not cool shows a fault, in a number of embodiments, and is (e.g., indicated to be) checked for proper wiring, a functioning actuator, or both, as examples. Further, if the zone control valve is operating properly, but little or no cooling is being observed, some embodiments may indicate to check the primary airflow to the beam(s) (e.g., of beams 1011 to 1015) serving the zone, the slot setting of the beam(s), or both, as examples. In various embodiments, step 5 is a double check of step 4, so all zones that pass step 4 should pass step 5.

In a number of embodiments, by following the steps outlined above, in FIGS. 3-8, or both, for example, the initial installation, start-up phase, and troubleshooting are accomplished. In various embodiments, the individual steps can be done individually or sequenced. In addition, in a number of embodiments, multiple pump modules (e.g., 102 and 103) can be tested simultaneously. In certain embodiments, for example, the process can be initiated via local or remote computer, BAS (e.g., 109), local keypad, or a combination thereof, as examples. In various embodiments, if no faults are detected, the start-up troubleshooting is a success. Further, in a number of embodiments, any fault pauses the process until issues are resolved, and then the test continues. Note that in addition to the checks noted above, in some embodiments, the process will also identify any space (e.g., zone) sensors (e.g., thermostats 1031 to 1035) that may be improperly set up or installed, or may be inoperable. Even further, in some embodiments, (e.g., only) the first step of this start-up and troubleshooting process requires a technician, for instance, to provide visual proof that the valves are operating. Once this is completed, in particular embodiments, the startup process can be set to automatically initiate, can be monitored on site by the BAS (e.g., 109) or remotely by factory support, or a combination thereof. In various embodiments, when a step shows a failure, targeted recommendations are made, for example, to remedy installation errors. Even further still, in a number of embodiments, once initial start-up and troubleshooting is completed, the system (e.g., 100) has been checked for potential installation problems and should be able to operate in full control mode (e.g., as intended) to heat and cool the facility (e.g., normally). In various embodiments, it is now ready for final commissioning mode (e.g., FIG. 8).

Various embodiments include a final commissioning mode, for instance, as shown in FIG. 8. In a number of embodiments, the added complexity of controlling multiple zones (e.g., 1001 to 1005) with one (e.g., chilled-beam) pump module (e.g., 102) creates final commissioning challenges which are simplified using on-board code, for example, integral to the pump module (e.g., 102, for instance, in controller 25). In various embodiments, the start-up steps eliminate installation issues, and the final commissioning mode tests to make sure that the system (e.g., 100) can satisfy the needs of the occupants, can accommodate the loads of the building (e.g., space 101), or both, as examples. In a number of embodiments, once the (e.g., zone) thermostats (e.g., 1031 to 1035) are set up, the system (e.g., 100) is operated in the normal operating mode. In many embodiments, each pump module (e.g., 102) monitors each zone (e.g., 1001 to 1005) that is served by the pump module (e.g., 102), for example, to compare the requested temperature set point with the actual zone temperature (e.g., at each of thermostats 1031 to 1035). In some embodiments, on-going trends of each zone temperature, trends of outdoor air temperature conditions (e.g., measured at sensor 108), or both, are collected. In certain embodiments, under extreme outdoor air conditions (e.g., hot, cold, or both) the conditions maintained in each zone (e.g., served by pump module 102) are compared (e.g., against the requested set point), for example, to make sure that conditions are achieved. If they are, in some embodiments, then it may be assumed that the heating/cooling capacity allocated for each zone (e.g., 1001 to 1005) is satisfied (e.g., each zone served by pump module 102). If not, then, in particular embodiments, secondary factors may need to be evaluated on a space-by-space (e.g., zone-by-zone) basis, for example, including chilled beam primary airflow, slot setting of the chilled beams (e.g., 1011 to 1015), load calculations vs capacity allocated, etc. Further, in some embodiments, once occupied, the occupants may provide feedback, for example, regarding comport levels within the individual zones (e.g., 1001 to 1005). In various embodiments, for example, remote monitoring (e.g., of the information described in this document) allows for a timely response to various comfort issues. Modest adjustments to primary airflow, beam slot adjustment, or both, in a number of embodiments, may address various complaints that may be made for a well-functioning multi zone (e.g., chilled-beam) pump module system (e.g., 100).

As discussed, various embodiments are or include a multiple-zone air conditioning system (e.g., 100), for example, for cooling a multiple-zone space (e.g., 101). In a number of embodiments, for example, the multiple-zone air conditioning system includes multiple zones (e.g., 1001 to 1005), multiple pump modules (e.g., 102 and 103), a chilled-water distribution system (e.g., 104), or a combination thereof, for example. Further, in various embodiments, each zone (e.g., 1001 to 1005), for instance, of the multiple zones, includes at least one chilled beam (e.g., 1011 to 1015), at least one zone thermostat (e.g., 1031 to 1035), or both. Still further, in a number of embodiments, each pump module (e.g., 102), for example, of the multiple pump modules (e.g., 102 and 103) includes a module pump (e.g., 21), and the module pump (e.g., of each pump module, for instance, 102) delivers chilled water (e.g., 22) to the at least one chilled beam (e.g., 1011 to 1015) in a plurality of the multiple zones (e.g., 1001 to 1005). Even further, in various embodiments, the chilled-water distribution system (e.g., 104) includes at least one chilled-water distribution pump (e.g., 1041), at least one chiller (e.g., 1042), a chilled-water distribution loop (e.g., 1043), or a combination thereof. Further still, in a number of embodiments, the at least one chiller cools the chilled water, and the chilled-water distribution pump circulates the chilled water through the chilled-water distribution loop, for example, to the multiple pump modules (e.g., 102 and 103), for instance, to be delivered by the module pump (e.g., 21) of each pump module (e.g., 102) to the at least one chilled beam (e.g., 1011 to 1015), for example, of each zone of the multiple zones (e.g., 1001 to 1005).

More broadly speaking, in a number of embodiments, each zone of the multiple zones (e.g., 1001 to 1005) includes at least one heat exchanger (e.g., chilled beams 1011 to 1015), for example, as well as at least one zone thermostat (e.g., 1031 to 1035). Such embodiments may also include multiple pump modules (e.g., 102 and 103) wherein each pump module (e.g., 102) of the multiple pump modules includes a module pump (e.g., 21), and the module pump (e.g., of each pump module) delivers chilled water (e.g., 22) to a plurality of the multiple zones (e.g., 1001 to 1005). Further, in some such embodiments, a chilled-water distribution system (e.g., 104) circulates chilled water, for example, through a chilled-water distribution loop (e.g., 1043) to the multiple pump modules (e.g., 102 and 103) to be delivered by the multiple pump modules to each zone of the multiple zones (e.g., 1001 to 1005). In some such embodiments, for example, the system includes the chilled-water distribution system (e.g., 104). Still further, in a number of embodiments, the module pump (e.g., of each pump module) delivers chilled water (e.g., 22) to the at least one heat exchanger in a plurality of the multiple zones (e.g., 1001 to 1005). Even further, in various embodiments, in at least one zone of the multiple zones (e.g., 1001 to 1005), in a plurality of the zones, or in each zone, the at least one heat exchanger includes at least one chilled beam (e.g., 1011 to 1015).

In a number of embodiments, the system (e.g., 100), for example, each pump module (e.g., 102) further includes a digital controller (e.g., 25). In some embodiments, for example, the digital controller receives input from multiple of the (e.g., at least one) zone thermostats (e.g., 1031 to 1035), for example, in each of the plurality of the multiple zones (e.g., 1001 to 1005) that receive the chilled water (e.g., 22) from that pump module (e.g., 102). Further, in some embodiments, for example, for each pump module (e.g., 102), at least one zone thermostat (e.g., 1031 to 1035) in a zone (e.g., 1001 to 1005) served by that pump module (e.g., 102) includes a humidistat. Still further, in particular embodiments, for at least one pump module (e.g., 102), each zone (e.g., 1001 to 1005) served by that pump module includes a zone thermostat (e.g., 1031 to 1035) that includes a humidistat. Even further, in certain embodiments, for each of at least a majority of the pump modules (e.g., 102), at least a majority of the zones (e.g., 1001 to 1005) served by that pump module (e.g., 102) comprise a zone thermostat (e.g., 1031 to 1035) that includes a humidistat. Even further still, in particular embodiments, for each of the pump modules, each of the zones (e.g., 1001 to 1005) served by that pump module comprise a zone thermostat (e.g., 1031 to 1035) that includes a humidistat. Further still, in various embodiments, the input from the at least one zone thermostat (e.g., 1031 to 1035) includes humidity or dew point within the at least one zone (e.g., 1001 to 1005). Moreover, in a number of embodiments, humidity or dew point within one, multiple, or each, as examples, of the plurality of the multiple zones (e.g., 1001 to 1005), is used to adjust temperature of the chilled water (e.g., 22) delivered to the plurality of the multiple zones, is used to avoid condensation on chilled beams (e.g., 1011 to 1015), or is used to avoid condensation on chilled beams within each of the plurality of the multiple zones (e.g., 1001 to 1005), as examples.

In some embodiments, each pump module (e.g., 102) of the multiple pump modules (e.g., 102 and 103) receives input from each of the plurality of the multiple zones (e.g., 1001 to 1005) that receive the chilled water (e.g., 22) from that pump module (e.g., 102). Further, in particular embodiments, the input includes humidity or dew point within the at least one zone, and the pump module (e.g., 102) adjusts temperature of the chilled water (e.g., 22) delivered to the plurality of the multiple zones (e.g., 1001 to 1005) that receive the chilled water (e.g., 22) from that pump module (e.g., 102) to avoid condensation on at least one chilled beam (e.g., 1011 to 1015) within the plurality of the multiple zones that receive the chilled water from that pump module. Further, in particular embodiments, this includes maintaining the temperature of the chilled water (e.g., 22) at least a predetermined temperature differential above a (e.g., maximum) dewpoint within the plurality of the multiple zones (e.g., 1001 to 1005) that receive the chilled water (e.g., 22) from the pump module (e.g., 102). In certain embodiments, for example, the (e.g., maximum) dewpoint is a highest dewpoint reported by the thermostats (e.g., 1031 to 1035) within the plurality of zones (e.g., 1001 to 1005) served by that pump module (e.g., 102). Still further, in various embodiments, the predetermined temperature differential: is at least one degree F., is one degree F., or is adjustable (e.g., at the pump module (e.g., 102)). Even further, in some embodiments, each pump module (e.g., 102) of the multiple pump modules recirculates water returning from the plurality of the multiple zones (e.g., 1001 to 1005) that receive the chilled water (e.g., 22) from that pump module (e.g., 102), for instance, to control temperature of the chilled water (e.g., 22) delivered to the plurality of the multiple zones (e.g., 1001 to 1005) that receive the chilled water (e.g., 22) from the pump module (e.g., 102). Further still, in some embodiments, each pump module (e.g., 102) of the multiple pump modules mixes water returning from the plurality of the multiple zones (e.g., 1001 to 1005) that receive the chilled water (e.g., 22) from that pump module, with water from the chilled water distribution loop (e.g., 1043), for example, to control temperature of the chilled water (e.g., 22) delivered from that pump module (e.g., 102) or delivered to the plurality of the multiple zones (e.g., 1001 to 1005) that receive the chilled water (e.g., 22) from that pump module (e.g., 102).

Further, in various embodiments, each pump module (e.g., 102) of the multiple pump modules (e.g., 102 and 103) includes a modulating valve (e.g., 24), for example, used to control temperature of the chilled water (e.g., 22) delivered from that pump module (e.g., 102) or delivered to the plurality of the multiple zones (e.g., 1001 to 1005) that receive the chilled water (e.g., 22) from that pump module (e.g., 102). Still further, in a number of embodiments, the pump module (e.g., 102, for example, controller 25) controls the modulating valve (e.g., 24), for instance, to control temperature of the chilled water (e.g., 22) delivered to the plurality of the multiple zones (e.g., 1001 to 1005) that receive the chilled water (e.g., 22) from the pump module (e.g., 102). Even further, in certain embodiments, the modulating valve (e.g., 24) is a three-way valve (e.g., as shown in FIG. 2).

As mentioned, in various embodiments, the multiple-zone air conditioning system (e.g., 100) includes multiple zone control valves (e.g., 1021 to 1025). In a number of embodiments, for example, each zone of the multiple zones (e.g., 1001 to 1005) includes a zone control valve. Further, in various embodiments, a plurality, a majority, at least ⅔, at least ¾, or at least ⅘ of the zone control valves are two-way valves (e.g., 1021 to 1024). In some embodiments, for example, for each pump module (e.g., 102) all but one (e.g., 1025) of the zone control valves are two-way valves (e.g., 1021 to 1024). Still further, in some embodiments, for example, for each pump module (e.g., 102), (e.g., only) one of the zone control valves (e.g., 1021 to 1025) is a three-way valve (e.g., 1025, as shown). Even further, in various embodiments, for each pump module (e.g., 102), at least one of the zone control valves is a three-way valve e.g., 1025). Even further still, in a number of embodiments, for each pump module (e.g., 102), there is at least one diverting valve (e.g., 1025) that allows water to recirculate through the module pump (e.g., 21) when water flow is shut off in all zones (e.g., 1001 to 1005) served by that pump module. Further still, in some embodiments, zone control valves (e.g., 1021 to 1024) are on/off valves. For example, in various embodiments, at least a majority of the zone control valves (e.g., 1021 to 1024) are normally either fully open or fully closed.

Moreover, in various embodiments, multiple zone control valves (e.g., 1021 to 1025) control whether the chilled water (e.g., 22) is circulated to the zones (e.g., 1001 to 1005), through the chilled beams (e.g., 1011 to 1015) in the zones (e.g., 1001 to 1005), or both. In a number of embodiments, each zone control valve (e.g., 1021 to 1025) controls whether the chilled water (e.g., 22) is circulated through at least one heat exchanger (e.g., chilled beam, for instance, 1011 to 1015) in one of the zones (e.g., 1001 to 1005). In various embodiments, each zone control valve (e.g., 1021 to 1025) is controlled by the pump module (e.g., 102) that delivers the chilled water (e.g., 22) to that zone control valve. Furthermore, in a number of embodiments, each zone control valve (e.g., 1021 to 1025) is controlled using input from the at least one zone thermostat (e.g., 1031 to 1035) in the zone (e.g., 1001 to 1005) served by that zone control valve. For example, in various embodiments, each zone control valve (e.g., 1021 to 1025) is controlled using a temperature set point received from the at least one zone thermostat (e.g., 1031 to 1035) in the zone (e.g., 1001 to 1005) served by that zone control valve. Further, in a number of embodiments, each zone control valve (e.g., 1021 to 1025) is controlled using a current temperature reading received from the at least one zone thermostat (e.g., 1031 to 1035) in the zone (e.g., 1001 to 1005) served by that zone control valve. For instance, in a number of embodiments, each zone control valve (e.g., 1021 to 1025) is open when the set point temperature is not satisfied in the zone (e.g., 1001 to 1005) served by that zone control valve. Still further, in various embodiments, each zone control valve (e.g., 1021 to 1025) is closed when the set point temperature is satisfied in the zone (e.g., 1001 to 1005) served by that zone control valve. Even further, in some embodiments, each zone control valve (e.g., 1021 to 1025) is closed when the at least one zone thermostat (e.g., 1031 to 1035) is turned off in the zone (e.g., 1001 to 1005) served by that zone control valve.

As described, in a number of embodiments, the plurality of the multiple zones (e.g., 1001 to 1005) that receive the chilled water (e.g., 22) from one pump module (e.g., 102) are chosen to have similar load profiles. For example, in various embodiments, the plurality of the multiple zones (e.g., 1001 to 1005) that receive the chilled water (e.g., 22) from one pump module (e.g., 102) are chosen to have similar sensible load profiles. For instance, in a number of embodiments, the plurality of the multiple zones (e.g., 1001 to 1005) that receive the chilled water (e.g., 22) from one pump module (e.g., 102) are chosen to face a same direction. Further, in some embodiments, the plurality of the multiple zones (e.g., 1001 to 1005) that receive the chilled water (e.g., 22) from one pump module (e.g., 102) are on different floors.

For example, in certain embodiments, the plurality of the multiple zones (e.g., 1001 to 1005) that receive the chilled water (e.g., 22) from one pump module (e.g., 102) are arranged in a vertical stack. Still further, in various embodiments, the plurality of the multiple zones that receive the chilled water (e.g., 22) from one pump module (e.g., 102) include: at least three zones, at least four zones. at least five zones, (e.g., specifically) five zones (e.g., zones 1001 to 1005 as shown in FIG. 1), no more than five zones, no more than six zones, no more than seven zones, no more than eight zones, no more than nine zones, or no more than ten zones, as examples.

Moreover, in various embodiments, when operating in a cooling mode, water (e.g., 22) temperature entering the chilled beams (e.g., 1011 to 1015) is controlled by each pump module (e.g., 102, for instance, by controller 25) to be at least a certain temperature differential (e.g., 1 degree F. or C.) above a dewpoint of a most-humid zone (e.g., 1001 to 1005) served by the pump module. Further, in a number of embodiments, the certain temperature differential is adjustable, for example, at the pump module (e.g., 102). Still further, in various embodiments, for example, when operating in a cooling mode, when a thermostat set point is not achieved within a preset period of time, speed of the module pump (e.g., 21) serving the zone (e.g., 1001 to 1005) containing that thermostat (e.g., 1031 to 1035) is increased. Even further, in some embodiments, the preset period of time is adjustable, for instance, at the pump module (e.g., 102). In certain embodiments, for example, the preset period of time is: at least five minutes, at least ten minutes, no more than 30 minutes, or no more than 20 minutes, as examples. Even further, in some embodiments, speed of the module pump (e.g., 21) serving the zone (e.g., 1001 to 1005) containing that thermostat (e.g., 1031 to 1035) is increased incrementally, until a maximum speed of the module pump (e.g., 21) serving the zone containing that thermostat is reached, or both.

Further still, in some embodiments, for example, when operating in a cooling mode, when a thermostat set point is achieved, speed of the module pump (e.g., 21) serving the zone (e.g., 1001 to 1005) containing that thermostat (e.g., 1031 to 1035) is decreased. Even further still, in particular embodiments, for example, when a thermostat set point is achieved within a particular period of time, speed of the module pump (e.g., 21) serving the zone (e.g., 1001 to 1005) containing that thermostat (e.g., 1031 to 1035) is decreased. Moreover, in certain embodiments, the particular period of time is adjustable, for instance, at the pump module (e.g., 102) serving the zone (e.g., 1001 to 1005) containing that thermostat (e.g., 1031 to 1035). Furthermore, in particular embodiments, for example, when operating in a cooling mode, when (e.g., all) thermostat set points have been achieved in all zones (e.g., 1001 to 1005) served by a pump module (e.g., 102), speed of the module pump (e.g., 21) of that pump module is decreased, for instance, incrementally, until a preset minimum module pump speed is reached, or both. In addition, in certain embodiments, the preset minimum module pump (e.g., 21) speed is adjustable, for example, at the pump module (e.g., 102) containing that module pump. Further, in some embodiments, for example, when a thermostat (e.g., 1031 to 1035) set point is not achieved in at least one zone (e.g., 1001 to 1005) served by a pump module (e.g., 102), if the highest dewpoint of a zone served by that pump module is more than a predetermined temperature differential below a chilled water (e.g., 22) temperature leaving that pump module, then the chilled water temperature leaving that pump module is lowered, for example, by that pump module, incrementally, until the highest dewpoint of the zone served by that pump module is the predetermined temperature differential below the chilled water temperature leaving that pump module, or a combination thereof.

In addition, in a number of embodiments, for example, the multiple-zone air conditioning system (e.g., 100) further includes a hot-water distribution system (e.g., 106 shown in FIG. 1). Further, in various embodiments, the hot-water distribution system (e.g., 106) includes at least one hot water distribution pump (e.g., 1061), at least one water heater (e.g., 1062), a hot water distribution loop (e.g., 1063), or a combination thereof. Still further, in a number of embodiments, the at least one water heater (e.g., 1062) heats hot water, and the hot water distribution pump (e.g., 1061) circulates the hot water through the hot water distribution loop (e.g., 1063) to the multiple pump modules (e.g., 102 and 103), for example, to be delivered by the module pump (e.g., 21) of each pump module (e.g., 102). For instance, in some embodiments, the hot water (e.g., 22) is delivered to at least one chilled beam (e.g., 1011 to 1015), for example, of each zone of the multiple zones (e.g., 1001 to 1005). Even further, in some embodiments, for example, when any zones (e.g., 1001 to 1005) served by a pump module (e.g., 102) call for heat during a heating season, hot water is supplied to that pump module (e.g., by hot-water distribution system 106). Further still, in particular embodiments, for instance, when some zones (e.g., some of 1001 to 1005) served by a pump module (e.g., 102) call for heat, and other zones (e.g., other of 1001 to 1005) served by that pump module call for cooling, the pump module (e.g., 102) alternates between delivering hot water, and delivering chilled water (e.g., 22). Even further still, in certain embodiments, for example, when any zones (e.g., any of 1001 to 1005) served by a pump module (e.g., 102) call for heat during the heating season, hot water is supplied by the module pump (e.g., 21) of that pump module to the zones (e.g., 1001 to 1005) served by that pump module. Moreover, in particular embodiments, for instance, when at least one zone (e.g., of 1001 to 1005) served by a pump module (e.g., 102) calls for heat during a cooling season, and no zone (e.g., of 1001 to 1005) served by that pump module calls for cooling, hot water: is supplied to that pump module, is supplied by that pump module to the at least one zone served by that pump module that calls for the heat, or both.

In various embodiments, for example, when at least one zone (e.g., 1001 to 1005) served by a pump module (e.g., 102) calls for heat, and at least one (e.g., other) zone served by that pump module calls for cooling: that pump module, a seasonal mode, or both, determines whether hot water or chilled water (e.g., 22) is supplied by that pump module. In some embodiments, for example, when at least one zone (e.g., of 1001 to 1005) served by a pump module (e.g., 102) calls for heat, and at least one zone served by that pump module calls for cooling, chilled water (e.g., 22) is supplied by that pump module until the at least one zone served by that pump module that calls for cooling has been satisfied. Further, in a number of embodiments, when at least one zone (e.g., of 1001 to 1005) served by a pump module (e.g., 102) calls for heat, and chilled water (e.g., 22) is being supplied by that pump module, each zone control valve (e.g., of 1021 to 1025) for the at least one zone that calls for heat is closed. Still further, in various embodiments, when at least one zone (e.g., of zones 1001 to 1005) served by a pump module (e.g., 102) calls for cooling, and hot water is being supplied by that pump module, each zone control valve (e.g., of valves 1021 to 1025) for the at least one zone that calls for cooling is closed. Even further, in a number of embodiments, when a set point is satisfied of a thermostat (e.g., of thermostats 1031 to 1035) in a zone (e.g., of 1001 to 1005) served by a pump module (e.g., 102), a zone control valve (e.g., of 1021 to 1025) for that zone is closed. Further still, in various embodiments, when at least one zone (e.g., of 1001 to 1005) served by a pump module (e.g., 102) calls for heat, and hot water is being supplied by that pump module, each zone control valve (e.g., of 1021 to 1025) is open for the at least one zone that calls for heat. Even further still, in a number of embodiments, when at least one zone (e.g., of 1001 to 1005) served by a pump module (e.g., 102) calls for cooling, and chilled water (e.g., 22) is being supplied by that pump module, each zone control valve (e.g., of 1021 to 1025) is open for the at least one zone that calls for cooling.

Furthermore, in some embodiments, for example, when at least one zone (e.g., of 1001 to 1005) served by a pump module (e.g., 102) calls for heat, and all other zones served by that pump module that are set for cooling are at set point (e.g., at corresponding thermostats 1031 to 1035), then: zone control valves (e.g., of 1021 to 1025) to all satisfied zones are closed, the pump module switches over from cooling to heating, or both. Moreover, in particular embodiments, the pump module switches over from cooling to heating following a delay, for example, to allow chilled water (e.g., 22) to leave distribution piping (e.g., 107) between that pump module (e.g., 102) and chilled beams (e.g., 1011 to 1015) that are serviced by that pump module. Further, in various embodiments, the pump module (e.g., 102) switches over from cooling to heating only if a set point request has been entered (e.g., at corresponding thermostat 1031 to 1035) that is within a certain range of temperature. Still further, in certain embodiments the certain range of temperature is adjustable, for example, at that pump module (e.g., 102). Even further, in some embodiments, the pump module (e.g., 102) switches over from cooling to heating only if the set point is at least a certain threshold temperature warmer than the measured zone temperature (e.g., 1.5, 2, 2.5, or 3 degrees F. or C. warmer). Even further still, in particular embodiments, the certain threshold temperature is adjustable, for instance, at that pump module (e.g., 102). Moreover, in certain embodiments, for example, when the pump module (e.g., 102) switches over from cooling to heating, the pump module operates in the heating mode for at least a minimum run time. Furthermore, in particular embodiments, the minimum run time is adjustable, for instance, at that pump module (e.g., 102). Further, in various embodiments, the minimum run time is: at least five minutes, at least seven minutes, no more than 30 minutes, no more than 20 minutes, or no more than 15 minutes, as examples.

In addition, in some embodiments, for example, when at least one zone (e.g., of zones 1001 to 1005) served by a pump module (e.g., 102) calls for heat, and all other zones served by that pump module that are set for cooling are at set point (e.g., at corresponding thermostat 1031 to 1035), then the pump module (e.g., controller 25) switches over from cooling to heating until the space (e.g., zone) temperature set point is reached of the at least one zone (e.g., of zones 1001 to 1005) served by a pump module (e.g., 102) that calls for heat. In other embodiments, when at least one zone (e.g., of 1001 to 1005) served by a pump module (e.g., 102) calls for heat, and all other zones served by that pump module that are set for cooling are at set point, then the pump module switches over from cooling to heating (e.g., at least) until the space temperature set point (e.g., of the at least one zone that is calling for heat) is within a particular temperature differential of the at least one zone served by a pump module that calls for the heat. Further, in various embodiments, for example, when at least one zone (e.g., of 1001 to 1005) served by a pump module (e.g., 102) calls for heat, and all other zones served by that pump module that are set for cooling are at set point, then the pump module switches over from cooling to heating until at least one of the other zones (e.g., of 1001 to 1005) served by that pump module (e.g., 102) that are set for cooling are no longer at set point (e.g., at corresponding thermostat 1031 to 1035). Still further, in particular embodiments, when at least one zone (e.g., of 1001 to 1005) served by a pump module (e.g., 102) calls for heat, and all other zones served by that pump module that are set for cooling are at set point, then the pump module switches over from cooling to heating until at least one of the other zones served by that pump module that are set for cooling are no longer within a particular temperature differential of set point, as another example. Even further, in certain embodiments, the particular temperature differential is adjustable, for instance, at the pump module (e.g., 102).

Still further, in various embodiments, for example, when a pump module (e.g., 102) is operating with requests from zone thermostats (e.g., of 1031 to 1035) for both heating and cooling in different zones (e.g., of 1001 to 1005) served by that pump module at the same time, the module pump (e.g., 21) is operated at a maximum speed. Even further, in particular embodiments, when a pump module (e.g., 102) is operating with requests from zone thermostats (e.g., of 1031 to 1035) for both heating and cooling in different zones (e.g., of 1001 to 1005) served by that pump module at the same time, the module pump (e.g., 21) is operated: at a maximum speed for a cooling mode, or at a maximum speed for a heating mode. Further still, in certain embodiments, the maximum speed (e.g., for the cooling mode, the heating mode, or both) is adjustable, for example, at that pump module (e.g., 102). Even further still, in various embodiments, determination of an operational mode of a pump module (e.g., 102) is: set by a heating balance point of a building (e.g., space 101) containing the multiple-zone air conditioning system (e.g., 100), based upon outdoor air temperature (e.g., measured at sensor 108); based upon thermostat (e.g., 1031 to 1035) settings within the zones (e.g., 1001 to 1005) served by the pump module (e.g., 102), based upon relative quantity of heating and cooling requests made by the thermostats (e.g., 1031 to 1035) within the zones (e.g., 1001 to 1005) served by the pump module, or a combination thereof.

In some embodiments, for example, when outdoor air temperature (e.g., measured at sensor 108) is below a predetermined balance point condition, the pump module (e.g., 102), the system (e.g., 100), or both, is operated in a heating priority mode. For example, in certain embodiments, when outdoor air temperature is below a predetermined balance point condition, the BAS (e.g., 109) provides a global command to the pump modules (e.g., 102 and 103) in the system (e.g., 100) to operate in a heating priority mode. Further, in various embodiments, the heating priority mode prioritizes zone(s) (e.g., of 1001 to 1005) that are requesting heating (e.g., at corresponding thermostat 1031 to 1035) before switching over to cool any zone(s) (e.g., of 1001 to 1005) that are requesting cooling. Still further, in a number of embodiments, when outdoor air temperature (e.g., measured at sensor 108) is above a predetermined balance point condition, the pump module (e.g., 102), system (e.g., 100), or both, is operated in a cooling priority mode. For example, in some embodiments, when outdoor air temperature is above a predetermined balance point condition, the BAS (e.g., 109) provides a global command to the pump modules (e.g., 102 and 103) in the system (e.g., 100) to operate in the cooling priority mode. Even further, in various embodiments, the cooling priority mode prioritizes zone(s) (e.g., of 1001 to 1005) that are requesting cooling before switching over to heat any zone(s) that are requesting heating. Even further still, in particular embodiments, the predetermined balance point condition is adjustable, for example, at the BAS.

In certain embodiments, determination of an operational mode of a pump module (e.g., 102) is made by the pump module (e.g., at controller 25). In some embodiments, for example, when a majority of the zones (e.g., of 1001 to 1005) served by a pump module (e.g., 102) have called for heating over a preceding period of time (e.g., without calling for cooling), the pump module converts to (e.g., or remains in) a heating dominant mode. Further, in particular embodiments, for instance, when a majority of the zones (e.g., of 1001 to 1005) served by a pump module (e.g., 102) have called for cooling over a preceding period of time (e.g., in certain embodiments without calling for heating), the pump module converts to a cooling dominant mode. Still further, in particular embodiments, the preceding period of time is adjustable, for example, at the pump module (e.g., 102). Even further, in various embodiments, the preceding period of time is at least one hour, the preceding period of time is no more than four hours, the preceding period of time is no more than three hours, or a combination thereof.

Additionally, in some embodiments, for example, when the set point is satisfied of all thermostats (e.g., 1031 to 1035) in all zones (e.g., 1001 to 1005) served by a pump module (e.g., 102), the module pump (e.g., 21) for that pump module is off (e.g., turned off by controller 25). Further, in various embodiments, for instance, when all zone control valves (e.g., 1021 to 1025) are closed for all zones (e.g., 1001 to 1005) served by a pump module (e.g., 102), the module pump (e.g., 21) for that pump module is off. In this context, as used herein, a zone control valve (e.g., one of valves 1021 to 1025) is considered closed when the zone control valve blocks the water (e.g., 22) from flowing through the heat exchanger(s) (e.g., chilled beams 1011 to 1015) served by that zone control valve. Still further, in some embodiments, when water temperature (e.g., at sensor 23) leaving the module pump (e.g., 21) is too hot, an alarm is reported (e.g., from the pump module, for instance, 102, to the BAS, for example, 109). Even further, in some embodiments, when a zone control valve (e.g., of 1021 to 1025) is showing an open status, but water temperature leaving the module pump (e.g., 21) serving that zone (e.g., 1001 to 1005) is too hot (e.g., hotter than a set point), an alarm is reported. Further still, in particular embodiments, when a zone control valve (e.g., any one of 1021 to 1025) is showing an open status, but water temperature (e.g., at sensor 23) leaving the module pump (e.g., 21) serving that zone (e.g., 1001 to 1005) is too (e.g., hot hotter than the heating set point, cooling set point, or both), the module pump is reported to be dead-heading. Even further still, in some embodiments, when a zone (e.g., at least one of 1001 to 1005) is not being conditioned while the zone control valve (e.g., of 1021 to 1025) for that zone is shown to be opened, an alarm is reported. Moreover, in certain embodiments, when a zone (e.g., one or more of 1001 to 1005) is not being conditioned despite a call for the zone control valve (e.g., of 1021 to 1025) for that zone to be open, an alarm reporting a zone control valve failure is sent, for example, from the pump module (e.g., 102, for instance, from controller 25, to the BAS (e.g., 109), or both).

Even further, in some embodiments, when a first zone (e.g., one of 1001 to 1005) served by a pump module (e.g., 102) is calling for heating, but is not responding, while a second zone (e.g., another of 1001 to 1005) served by that same pump module is overheating, an alarm is reported. Similarly, in some embodiments, when a first zone served by a pump module (e.g., 102) is calling for cooling, but is not responding, while a second zone served by that same pump module is overcooling, an alarm is reported. Still further, in certain embodiments, the alarm indicates cross-wiring, identifies the first zone (e.g., by room number), identifies the second zone, is reported by that same pump module (e.g., 102), is reported to the BAS (e.g., 109), or a combination thereof. Further, in some embodiments, when a dewpoint in a zone (e.g., one of 1001 to 1005) exceeds a dewpoint threshold, a zone control valve (e.g., the corresponding one of 1021 to 1025) for that zone is closed, for example, until the dewpoint in the zone drops below the dewpoint threshold. Further still, in particular embodiments, when a dewpoint in a zone (e.g., of 1001 to 1005) exceeds a dewpoint threshold, the pump module (e.g., 102) that serves that zone: closes the zone control valve (e.g., of 1021 to 1025) for that zone, ignores that zone from limiting the chilled water (e.g., 22) supply temperature to other zones served by that pump module, reports an alarm (e.g., to the BAS (e.g., 109), for example, that a room is out of humidity control and should be checked), or a combination thereof.

In particular embodiments, each pump module (e.g., 102) includes a conduit (e.g., 27 shown in FIG. 2), for example, for passing water. Further, in certain embodiments, the conduit (e.g., 27) includes a supply portion (e.g., 271) that supplies the water (e.g., 22) to at least one chilled beam (e.g., 1011 to 1015), and a return portion (e.g., 272) that returns the water from the at least one chilled beam. Still further, in some embodiments, the return portion (e.g., 272) is connected to the supply portion (e.g., 271), and the water recirculates from the return portion (e.g., 272) to the supply portion (e.g., 271), for example, to control temperature of the at least one chilled beam (e.g., 1011 to 1015). Even further, in some embodiments, (e.g., each) pump module (e.g., 102) includes a chilled-water inlet (e.g., 241 shown in FIG. 2) connecting the chilled-water distribution system (e.g., 104 shown in FIG. 1) to the supply portion (e.g., 271) of the conduit (e.g., 27), a chilled-water outlet (e.g., 242) connecting the return portion (e.g., 272) of the conduit (e.g., 27) to the chilled-water distribution system (e.g., 104), a chilled water control valve (e.g., 24) located in the chilled-water inlet (e.g., 241, as shown) or in the chilled-water outlet (e.g., 242, not show), for instance, where the chilled water control valve (e.g., 24) controls flow of the water between the chilled-water distribution system (e.g., 104) and the conduit (e.g., 27). Further still, in some embodiments, the module pump (e.g., 21) is mounted in the conduit (e.g., 27) and the module pump circulates the water from the chilled-water distribution system (e.g., 104) through the chilled-water inlet (e.g., 241), the supply portion (e.g., 271) of the conduit (e.g., 27), the at least one chilled beam (e.g., 1011 to 1015), the return portion (e.g., 272) of the conduit (e.g., 27), and the chilled-water outlet (e.g., 242) to the chilled-water distribution system (e.g., 104) to cool the at least one chilled beam (e.g., 1011 to 1015), recirculates the water from the return portion (e.g., 272) of the conduit to the supply portion (e.g., 271) of the conduit, or both, for example, to control temperature of the at least one chilled beam (e.g., 1011 to 1015).

Further, as mentioned, in some embodiments, the multiple-zone air conditioning system (e.g., 100) further includes a water temperature sensor (e.g., 23) that measures water temperature, for example, leaving the pump module (e.g., 102), entering the at least one chilled beam (e.g., 1011 to 1015), for instance, served by that pump module, or both. Still further, in various embodiments, each pump module (e.g., 102) includes a chilled water control valve (e.g., 24), a digital controller (e.g., 25), or both. Even further, in some embodiments, the digital controller (e.g., 25), for example, is specifically configured to control the chilled water control valve (e.g., 24), for example, based upon input from the zone thermostats (e.g., 1031 to 1035), for example, to control temperature of water (e.g., 22) delivered to chilled beams (e.g., 1011 to 1015) to keep the water temperature entering the chilled beams above a present dew point temperature within the multiple zones (e.g., 1001 to 1005). Further still, in some embodiments, for example, the digital controller (e.g., 25) controls speed of the module pump (e.g., 21), for example, in some embodiments, when operating in a cooling mode, slowing the module pump, for instance, to reduce energy consumption of the module pump, for example, when a measured space temperature (e.g., within space 101, zones 1001 to 1005, or a combination thereof) is below a set-point temperature (e.g., entered at one of thermostats 1031 to 1035). Even further, in some embodiments, the digital controller (e.g., 25) controls speed of the module pump (e.g., 21) including, when operating in a cooling mode, accelerating the module pump, for example, to increase cooling capacity of at least one chilled beam (e.g., 1011 to 1015), for instance, by evening out temperature of the at least one chilled beam, for example, when a measured space temperature (e.g., within space 101 or the zones therein) is above the set-point temperature (e.g., entered into one or more of thermostats 1031 to 1035). Even further still, in various embodiments, (e.g., each) module pump (e.g., 21) is a multiple-speed pump, for example, (e.g., each) module pump (e.g., 21) is a variable-speed pump. Moreover, in certain embodiments, the digital controller (e.g., 25) controls speed of the module pump (e.g., 21), for example, including controlling space (temperature e.g., within one or more of zones 1001 to 1005), for instance, by controlling speed of the module pump.

As described, in various embodiments, each pump module (e.g., 102) includes a digital controller (e.g., 25) that controls the pump module including, for example, when operating in a cooling mode, receiving from each of the plurality of the multiple zones (e.g., 1001 to 1005) a measured humidity, a dew point, or a parameter that can be used to calculate humidity or dew point within the zone, receiving a measured temperature of the water (e.g., 22) leaving the pump module and entering at least one chilled beam (e.g., 1011 to 1015), and controlling the temperature of the water (e.g., 22) leaving the pump module and entering at least one chilled beam, and maintaining that temperature of the water (e.g., 22) at least a predetermined temperature differential above a dew point within at least one zone (e.g., of 1001 to 1005) that is served by that pump module (e.g., 102). Further, in a number of embodiments, each pump module (e.g., 102) includes a chilled-water control valve (e.g., 24) that the pump module automatically modulates to control temperature of water (e.g., 22) leaving the pump module. Still further, in various embodiments, the chilled-water control valve (e.g., 24) regulates how much water passing through the module pump (e.g., 21) is recirculated through the chilled beams (e.g., 1011 to 1015) and how much of the water passing through the module pump is circulated from the chilled-water distribution system (e.g., 104). Even further, in a number of embodiments, each pump module (e.g., 102, for instance, controller 25) automatically regulates how much water (e.g., 22) passing through the module pump (e.g., 21) is recirculated through the chilled beams (e.g., 1011 to 1015) and how much of the water (e.g., 22) passing through the module pump is circulated from the chilled-water distribution system (e.g., 104). Further still, in various embodiments, each pump module (e.g., 102) includes a conduit (e.g., 27) through which water passes. In a number of embodiments, for example, the conduit (e.g., 27) includes a supply portion (e.g., 271) supplying water to at least one chilled beam (e.g., 1011 to 1015) located within the multiple zones (e.g., 1001 to 1005) of the air conditioning system (e.g., 100), the conduit (e.g., 27) includes a return portion (e.g., 272) returning the water from the at least one chilled beam, or both. Moreover, various embodiments include a chilled-water inlet (e.g., 241), for example, connecting the chilled-water distribution system (e.g., 104) to the supply portion (e.g., 271) of the conduit (e.g., 27), a chilled-water outlet (e.g., 242), for instance, connecting the return portion (e.g., 272) of the conduit (e.g., 27) to the chilled-water distribution system (e.g., 104), or both. Even further still, in some embodiments, the multiple-zone air conditioning system (e.g., 100) further includes restriction of flow (e.g., control valve 24 in the embodiment shown) of the water, for example, from the return portion (e.g., 272) of the conduit (e.g., 27) to the supply portion (e.g., 271) of the conduit (e.g., 27), In various embodiments, for example, this restriction provides for flow of water through the chilled-water inlet (e.g., 241), the chilled-water outlet (e.g., 242), or both, for instance, to control temperature of at least one chilled beam (e.g., 1011 to 1015).

In many embodiments, each pump module (e.g., 102) further includes a hot-water inlet (e.g., 261 shown in FIG. 2) connecting a hot-water distribution system (e.g., 106 shown in FIG. 1) to the supply portion (e.g., 271) of the conduit (e.g., 27), a hot water outlet (e.g., 262) connecting the return portion (e.g., 272) of the conduit (e.g., 27) to the warm-water distribution system (e.g., 106), or both. Further, in some embodiments, each pump module (e.g., 102) further includes a first check valve (e.g., 281), for example, located in one of the chilled-water inlet (not shown) or the hot-water inlet (e.g., 261, as shown in FIG. 2), a second check valve (e.g., 282), for instance, located in one of the chilled-water outlet (e.g., 242, as shown) or the hot-water outlet (not shown), or both. Further still, in certain embodiments, the first check valve (e.g., 281) and the second check valve (e.g., 282) equalize pressure between the hot-water distribution system (e.g., 106) and the chilled-water distribution system (e.g., 104), for example, to prevent excessive buildup of pressure within the hot-water distribution system (e.g., 106), for instance, due to expansion from increasing temperature. Still further, various embodiments are or include a building (e.g., space 101), for example, that includes an embodiment of the multiple-zone air conditioning system (e.g., 100) described herein or that implement a method described herein.

In fact, various embodiments are or include a method, for example, of controlling a chilled-beam air conditioning system (e.g., 100), for instance, that cools a multiple-zone space (e.g., 101). In a number of embodiments, for example, the method includes at least certain acts. Such acts may include, for example, delivering chilled water (e.g., from chilled water distribution system 104) to multiple pump modules (e.g., 102 and 103). In some embodiments, for instance, each pump module (e.g., 102) of the multiple pump modules includes a module pump (e.g., 21). Further, in various embodiments, the module pump delivers the chilled water (e.g., 22) to chilled beams (e.g., 1011 to 1015) in a plurality of zones (e.g., 1001 to 1005) of the multiple-zone space (e.g., 101). Still further, in various embodiments, each pump module (e.g., 102) determines dew points in zones that call for cooling (e.g., of zones 1001 to 1005), determines a highest dew point of the dew points within the zones that call for cooling, or both. Even further, various embodiments include maintaining temperature of chilled water (e.g., 22) delivered to the zones (e.g., of zones 1001 to 1005) that call for cooling, for instance, at least a predetermined temperature differential above the highest dew point of the dew points of the zones that call for cooling. Further still, in some embodiments, for example, for each pump module (e.g., 102), the act of determining the highest dewpoint is performed at the pump module, the act of maintaining the temperature of the chilled water (e.g., 22) is performed at the pump module, or both. Even further still, in some embodiments, for instance, for each pump module (e.g., 102), the predetermined temperature differential is adjustable, for example, at the pump module. Moreover, in various embodiments, each zone (e.g., of the plurality of zones, of the multiple zones, or of the zones that call for cooling, for instance, of 1001 to 1005) includes: at least one chilled beam (e.g., 1011 to 1015), at least one zone thermostat (e.g., 1031 to 1035), or both. Furthermore, in a number of embodiments, the zone thermostat (e.g., 1031 to 1035): calls for the cooling in the zones that call for cooling, provides a measurement used in the determining of the dew points in the zones that call for the cooling, or both.

Meanwhile, in some embodiments, the act of delivering the chilled water to the multiple pump modules (e.g., 102 and 103) includes operating a chilled-water distribution system (e.g., 104), for example, that includes: at least one chilled-water distribution pump (e.g., 1041), at least one chiller (e.g., 1042), a chilled-water distribution loop (e.g., 1043), or a combination thereof. Further, in various embodiments, the act of delivering the chilled water to the multiple pump modules (e.g., 102 and 103) includes cooling the chilled water (e.g., at chiller 1042), circulating the chilled water through the chilled-water distribution loop (e.g., 1043), or both. For example, some embodiments include delivering the chilled water to the multiple pump modules, for example, to be delivered by each pump module (e.g., 102) to the zones (e.g., 1001 to 1005) that call for cooling (e.g., at respective thermostats 1031 to 1035). In various embodiments, certain acts are performed simultaneously, continuously, or both.

This disclosure illustrates, among other things, examples of certain embodiments and particular aspects thereof. Other embodiments may differ. Various embodiments may include aspects shown in the drawings, described in the text, shown or described in other documents that are identified, known in the art, or a combination thereof, as examples. Moreover, certain procedures may include acts such as obtaining or providing various structural components described herein and obtaining or providing components that perform functions described herein. Furthermore, various embodiments include advertising and selling products that perform functions described herein, that contain structure described herein, or that include instructions to perform acts or functions described herein, as examples. The subject matter described herein also includes various means for accomplishing the various functions or acts described herein or that are apparent from the structure and acts described. Further, as used herein, the word "or", except where indicated otherwise, does not imply that the alternatives listed are mutually exclusive. Even further, where alternatives are listed herein, it should be understood that in some embodiments, fewer alternatives may be available, or in particular embodiments, just one alternative may be available, as examples.

Further, other embodiments include a building that includes an air conditioning unit or HVAC unit or system described herein. Various methods in accordance with different embodiments include acts of selecting, making, positioning, assembling, or using certain components, as examples. Other embodiments may include performing other of these acts on the same or different components, or may include fabricating, assembling, obtaining, providing, ordering, receiving, shipping, or selling such components, or other components described herein or known in the art, as other examples. Further, different embodiments include various combinations of the components, features, and acts described herein or shown in the drawings, for example. Other embodiments may be apparent to a person of ordinary skill in the art having studied this document.

What is claimed is:

1. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, when some zones of the plurality of zones that are served by the pump module of the multiple pump modules call for heat, and other zones of the plurality of zones that are served by the pump module of the multiple pump modules call for cooling: the pump module of the multiple pump modules alternates between delivering hot water and delivering chilled water; and the pump module of the multiple pump modules determines whether the hot water or the chilled water is delivered by the pump module of the multiple pump modules.

2. The multiple-zone air conditioning system of claim 1 wherein the maximum dewpoint is a highest dewpoint reported by the zone thermostat or the zone humidistat within the plurality of the multiple zones served by the pump module of the multiple pump modules.

3. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones; humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, at least one zone control valve is a diverting valve that allows the chilled water to circulate through the module pump when flow of the chilled water through the at least one chilled beam is shut off at the zone control valve in all of the plurality of the multiple zones that receive the chilled water from the module pump.

4. The multiple-zone air conditioning system of claim 1 wherein, for each pump module of the multiple pump modules, each zone control valve is controlled by the digital controller using a temperature set point received from the zone thermostat in the zone of the multiple zones served by the zone control valve.

5. The multiple-zone air conditioning system of claim 1 wherein a particular zone control valve is open when a set point temperature is not satisfied in the zone served by the particular zone control valve; and the particular zone control valve is closed when the set point temperature is satisfied in the zone served by the particular zone control valve.

6. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, locations of all of the plurality of the multiple zones that receive the chilled water from the pump module of the multiple pump modules are designed to have similar sensible load profiles.

7. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, when operating in a cooling mode, when a thermostat set point within the plurality of the multiple zones is not achieved within a preset time, speed of the module pump is increased to provide more cooling output.

8. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, when a thermostat set point within the plurality of the multiple zones is not achieved when operating in a cooling mode, and the maximum dewpoint within the plurality of the multiple zones that receive the chilled water from the pump module of the multiple pump modules is more than a predetermined temperature differential below the temperature of the chilled water delivered from the pump module of the multiple pump modules to the plurality of the multiple zones, then the temperature of the chilled water delivered from the pump module of the multiple pump modules to the plurality of the multiple zones is lowered until the maximum dewpoint within the plurality of the multiple zones that receive the chilled water from the pump module of the multiple pump modules is the predetermined temperature differential below the temperature of the chilled water delivered from the pump module of the multiple pump modules to the plurality of the multiple zones.

9. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water; and the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and further comprising a hot-water distribution system comprising:

at least one hot water distribution pump;

at least one water heater; and a hot water distribution loop;

wherein:

the at least one water heater heats hot water;

the hot water distribution pump circulates the hot water through the hot water distribution loop to the multiple pump modules to be delivered by the module pump of each pump module of the multiple pump modules; and for each pump module of the multiple pump modules, when any zones of the plurality of zones that are served by the pump module of the multiple pump modules call for heat during a heating season, the hot water is supplied to the pump module of the multiple pump modules.

10. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and for each pump module of the multiple pump modules, when at least one zone of the plurality of zones served by the pump module of the multiple pump modules calls for heat, and all other zones of the plurality of zones served by that pump module that are set for cooling are at set point, then the zone control valves of all satisfied zones of the plurality of zones are closed, and the pump module of the multiple pump modules switches over from a cooling mode to a heating mode including opening the zone control valve serving each zone of the plurality of zones served by the pump module of the multiple pump modules that call for heat after a delay to allow chilled water to leave distribution piping between the pump module of the multiple pump modules and chilled beams that are serviced by the pump module of the multiple pump modules; and the pump module of the multiple pump modules operates in the heating mode for at least a minimum run time.

11. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:
at least one chilled-water distribution pump;
at least one chiller; and
a chilled-water distribution loop;
wherein:
the at least one chiller cools the chilled water;
the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and
when at least one zone of the plurality of the multiple zones served by a particular pump module of the multiple pump modules calls for heat, and all other zones of the plurality of the multiple zones served by the particular pump module that are set for cooling are at set point, then the particular pump module switches over from cooling to heating until at least one of the other zones of the plurality of the multiple zones served by the particular pump module that are set for cooling is no longer within a particular temperature differential of set point.

12. A multiple-zone air conditioning system for cooling a multiple-zone space, the multiple-zone air conditioning system comprising:
multiple zones, each zone of the multiple zones comprising:
at least one chilled beam;
a zone control valve that controls whether chilled water is circulated through the at least one chilled beam within the zone of the multiple zones;
a zone thermostat measuring temperature within the zone of the multiple zones; and
a zone humidistat measuring within the zone of the multiple zones: humidity, dew point, or a parameter that can be used to calculate humidity or dew point;
multiple pump modules wherein: each pump module of the multiple pump modules comprises:
a module pump that delivers the chilled water to the at least one chilled beam in a plurality of the multiple zones;
a water temperature sensor that measures temperature of the chilled water delivered by the module pump to the at least one chilled beam in the plurality of the multiple zones served by the pump module of the multiple pump modules;
a modulating valve that controls temperature of the chilled water delivered from the pump module of the multiple pump modules; and
a digital controller that:
receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;
receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and
a chilled-water distribution system comprising:
at least one chilled-water distribution pump;
at least one chiller; and
a chilled-water distribution loop;
wherein:
the at least one chiller cools the chilled water;
the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and
each pump module of the multiple pump modules controls speed of the module pump of the pump module of the multiple pump modules including, when operating in a cooling mode:
slowing the module pump of the pump module of the multiple pump modules to reduce energy consumption of the module pump of the pump module of the multiple pump modules when measured space temperature is at or below set-point temperature in all zones of the plurality of zones served by the pump module of the multiple pump modules that are set for cooling; and
accelerating the module pump of the pump module of the multiple pump modules to increase cooling capacity of at least one chilled beam served by the pump module of the multiple pump modules by evening out temperature of the at least one chilled beam in of the plurality of zones served by the pump module of the multiple pump modules when measured space temperature in the zone of the plurality of zones containing the at least one chilled beam is at least a predetermined temperature differential above the set-point temperature of the zone of the plurality of zones containing the at least one chilled beam.

13. The multiple-zone air conditioning system of claim 12 wherein:
the maximum dewpoint is a highest dewpoint reported by the zone thermostat or the zone humidistat within the plurality of the multiple zones served by the pump module of the multiple pump modules; and
for each pump module of the multiple pump modules, each zone control valve is controlled by the digital controller using a temperature set point received from the zone thermostat in the zone of the multiple zones served by the zone control valve.

14. A multiple-zone air conditioning system for cooling a multiple-zone space, the multiple-zone air conditioning system comprising:
multiple zones, each zone of the multiple zones comprising:
at least one chilled beam;
a zone control valve that controls whether chilled water is circulated through the at least one chilled beam within the zone of the multiple zones;
a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones;

when a particular pump module of the multiple pump modules is operating with concurrent requests from zone thermostats for both heating and cooling in different zones of the plurality of zones served by the particular pump module, the module pump of the particular pump module is operated at a maximum speed; and the maximum speed is adjustable.

15. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones;

determination of an operational mode of each pump module of the multiple pump modules is set by a heating balance point of a building containing the multiple-zone air conditioning system; and determination of the operational mode of each pump module of the multiple pump modules is based upon outdoor air temperature.

16. The multiple-zone air conditioning system of claim 1 wherein determination of an operational mode of a particular pump module of the multiple pump modules is based upon relative quantity of heating and cooling requests made by the zone thermostats within the plurality of the multiple zones served by the particular pump module.

17. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones;

when outdoor air temperature is below a predetermined balance point condition, a building automation system provides a first global command to each pump module of the multiple pump modules to operate in a heating priority mode; and when the outdoor air temperature is above the predetermined balance point condition, the building automation system provides a second global command to each pump module of the multiple pump modules to operate in a cooling priority mode.

18. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones;

when a majority of zones of the plurality of the multiple zones served by a particular pump module of the multiple pump modules have called for heating over a preceding period of time, without calling for cooling, the particular pump module converts to a heating priority mode; and when a majority of the zones of the plurality of the multiple zones served by the particular pump module of the multiple pump modules have called for cooling over the preceding period of time, without calling for heating, the particular pump module converts to a cooling priority mode.

19. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and when set point is satisfied for all zone thermostats in all zones of the plurality of the multiple zones served by a particular pump module of the multiple pump modules, the module pump for the particular pump module is off.

20. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and the digital controller of each pump module of the multiple pump modules is programmed to support: installation commissioning, troubleshooting, and ongoing performance monitoring by showing alarms locally at the pump module or by sending the alarms to a building automation system; including, when a particular zone control valve is showing an open status, but water temperature leaving the module pump of the pump module of the multiple pump modules serving the particular zone control valve is hotter than a cooling set point from the zone thermostat of the zone served by the particular zone control valve, the module pump is reported to be dead-heading.

21. The multiple-zone air conditioning system of claim 1 wherein, when a particular zone of the multiple zones is not being conditioned despite a call for the zone control valve for the particular zone to be open, an alarm reporting failure of the zone control valve for the particular zone is reported.

22. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and when a first zone of the plurality of the multiple zones served by a particular pump module of the multiple pump modules is calling for heating, but is not responding, while a second zone of the plurality of the multiple zones served by the particular pump module is overheating, an alarm is reported indicating cross wiring.

23. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and when a first zone of the plurality of the multiple zones served by a particular pump module of the multiple pump modules is calling for cooling, but is not responding, while a second zone of the plurality of the multiple zones served by the particular pump module is overcooling, an alarm is reported indicating cross wiring.

24. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and when a dewpoint in a particular zone of the multiple zones exceeds a dewpoint threshold, a particular pump module of the multiple pump modules that serves the particular zone closes the zone control valve for the particular zone.

25. A multiple-zone air conditioning system for cooling a multiple-zone space, the multiple-zone air conditioning system comprising:

multiple zones, each zone of the multiple zones comprising:

at least one chilled beam;

a zone control valve that controls whether chilled water is circulated through the at least one chilled beam within the zone of the multiple zones;

a zone thermostat measuring temperature within the zone of the multiple zones; and a zone humidistat measuring within the zone of the multiple zones: humidity, dew point, or a parameter that can be used to calculate humidity or dew point;

multiple pump modules wherein: each pump module of the multiple pump modules comprises:

a module pump that delivers the chilled water to the at least one chilled beam in a plurality of the multiple zones;

a water temperature sensor that measures temperature of the chilled water delivered by the module pump to the at least one chilled beam in the plurality of the multiple zones served by the pump module of the multiple pump modules;

a modulating valve that controls temperature of the chilled water delivered from the pump module of the multiple pump modules; and a digital controller that:

receives input from the zone thermostat in each of the plurality of the multiple zones that receive the chilled water from the pump module of the multiple pump modules, wherein the input from the zone thermostat includes: the temperature within the zone of the multiple zones; and whether the zone thermostat calls for cooling;

receives input from the zone humidistat in each of the plurality of the multiple zones that receive the chilled water from the pump module of the multiple pump modules; and controls the modulating valve to control the temperature of the chilled water delivered from the pump module of the multiple pump modules to the plurality of the multiple zones; including maintaining the temperature of the chilled water at least a predetermined temperature differential above a maximum dewpoint within the plurality of the multiple zones that receive the chilled water from the pump module of the multiple pump modules; and a chilled-water distribution system comprising:

at least one chilled-water distribution pump;

at least one chiller; and a chilled-water distribution loop;

wherein:

the at least one chiller cools the chilled water;

the at least one chilled-water distribution pump circulates the chilled water through the chilled-water distribution loop to each pump module of the multiple pump modules to be delivered by the module pump of each pump module of the multiple pump modules to the at least one chilled beam of each zone of the multiple zones; and when a dewpoint in a particular zone of the plurality of the multiple zones exceeds a dewpoint threshold for a preset time period, the pump module of the multiple pump modules that serves the particular zone sends an alarm to a building automation system that the particular zone is out of humidity control and should be checked.

* * * * *